US006375180B1

(12) United States Patent
Kawano et al.

(10) Patent No.: US 6,375,180 B1
(45) Date of Patent: Apr. 23, 2002

(54) SHEET FINISHER, IMAGE FORMING APPARATUS, AND SHEET CONVEYANCE APPARATUS

(75) Inventors: Minoru Kawano; Tsuyoshi Tsuchiya; Masaru Ohtsuka, all of Hachioji; Toshitaka Matsumoto, Tokyo; Hirohiko Okabe, Tokorozawa; Tadahiro Takahashi, Hoya, all of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/572,366

(22) Filed: May 17, 2000

(30) Foreign Application Priority Data

May 19, 1999 (JP) ..... 11-138698
Jun. 8, 1999 (JP) ..... 11-160924

(51) Int. Cl.[7] ..... B65H 31/32

(52) U.S. Cl. ..... 270/58.09; 270/58.04; 270/58.14; 271/3.14; 271/3.2; 271/262; 271/265.04

(58) Field of Search ..... 270/58.04, 58.08, 270/58.09, 58.14; 271/3.01, 3.05, 3.06, 3.14, 3.18, 3.2, 262, 265.04, 273

(56) References Cited

U.S. PATENT DOCUMENTS 4,669,721 A * 6/1987 Westover ..... 271/272
5,098,078 A * 3/1992 Nakanishi ..... 271/10.11
5,112,034 A * 5/1992 Uto et al. ..... 270/58.12
5,328,163 A * 7/1994 Yamada ..... 271/10.01
5,335,899 A * 8/1994 Golicz ..... 271/34
5,449,162 A * 9/1995 Saito et al. ..... 271/122

FOREIGN PATENT DOCUMENTS

JP 5-165356 * 7/1993
JP 6-321383 * 11/1994

* cited by examiner

*Primary Examiner*—Christopher P. Ellis
*Assistant Examiner*—Patrick Mackey
(74) *Attorney, Agent, or Firm*—Bierman, Muserlian and Lucas

(57) ABSTRACT

The present invention relates to a sheet finisher, which receives sheets from an image forming apparatus, such as an electro-photographic copying machine, a printer, a facsimile, etc., to align and bind the sheets. There is described a sheet finisher which includes a conveyance roller pair to convey the sheets, an intermediate stacker to stack the sheets, an aligning device to align the sheets stacked on the intermediate stacker, a binder to bind the sheets stacked and aligned on the intermediate stacker, an ejector to convey and eject the sheets bound by the binder, a driver to drive the aligning device, a controller to control the driver and an overlapped sheets conveying device to grip and convey two sheets. In the sheet finisher, the controller controls the driver in a manner such that the aligning device aligns an initial one sheet stacked on the intermediate stacker under a first aligning condition, while the aligning device aligns two overlapped sheets under a second aligning condition.

14 Claims, 24 Drawing Sheets

FIG. 20 ( a )
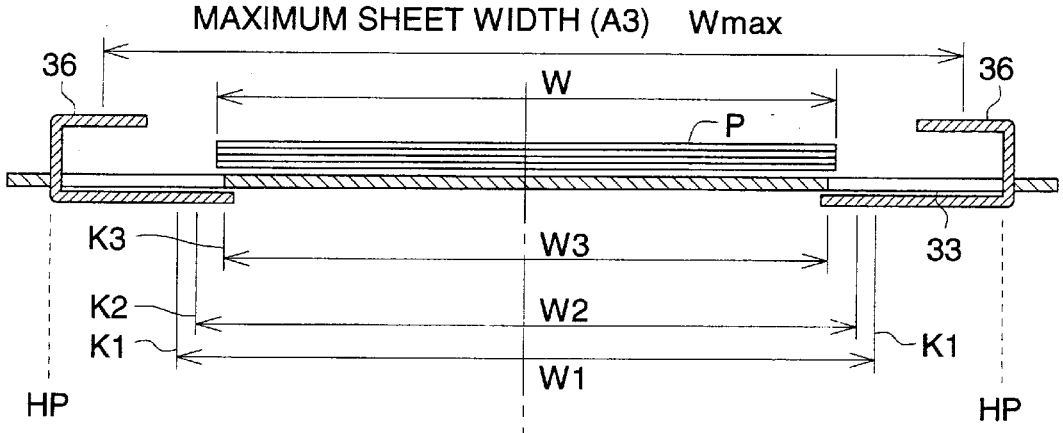
FIG. 20 ( b )
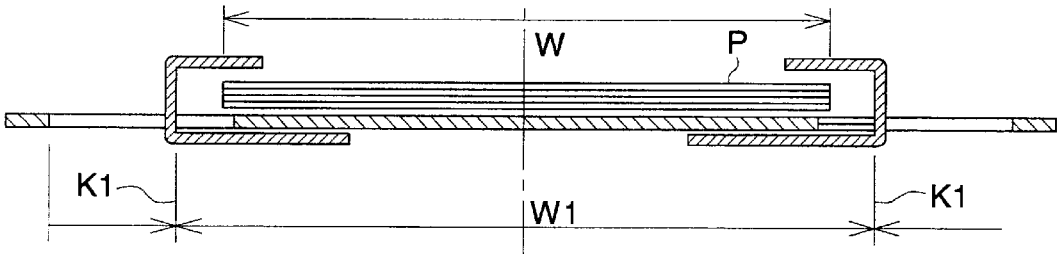
FIG. 20 ( c )
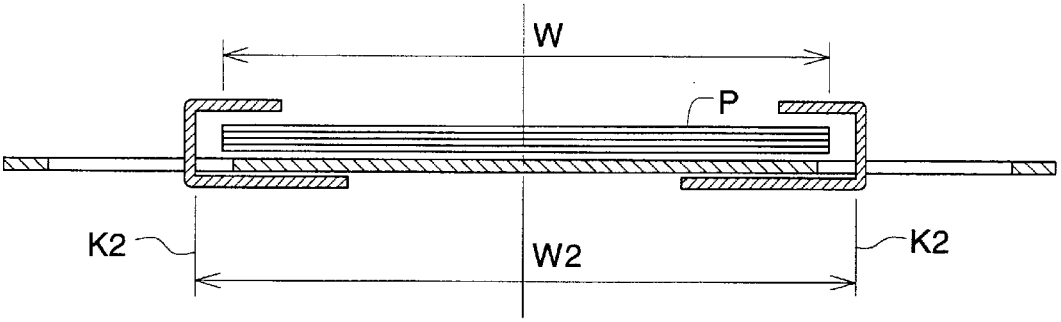
FIG. 20 ( d )
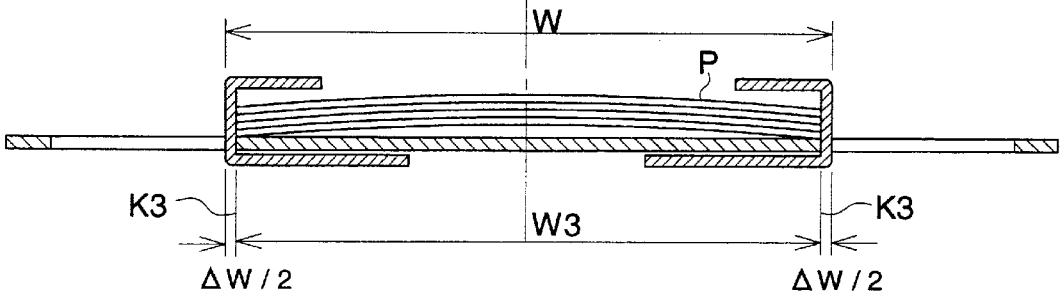

FIG. 21

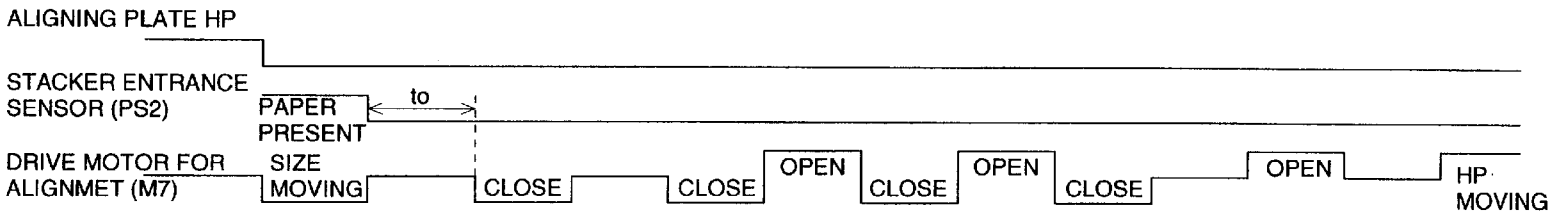

| | | | CLOSE (STEP) | Wail (ms) | CLOSE (STEP) | OPEN (STEP) | CLOSE (STEP) | OPEN (STEP) | CLOSE (STEP) | | OPEN (STEP) | CLOSE (ms) |
|---|---|---|---|---|---|---|---|---|---|---|---|---|
| USUAL ALIGNMENT | LARGE-SIZED | | - 10 | t1 | - 21 | 31 | | | | | | |
| | R-SIZED | | - 10 | t2 | - 15 | 25 | | | | | | |
| | SMALL-SIZED | 5 SHEETS OR LESS | - 10 | t2 | - 26 | 36 | | | | | | |
| | | 6 SHEETS OR MORE | - 10 | t2 | - 15 | 25 | | | | | | |
| 10 TIMES ALIGNMENTS | LARGE-SIZED | | - 10 | t1 | - 23 | 31 | | | | | | |
| 13 TIMES ALIGNMENTS | R-SIZED | | - 10 | t2 | - 18 | 27 | | | | | | |
| | SMALL-SIZED | | - 10 | t2 | - 18 | 27 | | | | | | |
| ALIGNMENT (LAST SHEET) | LARGE-SIZED | 9 SHEETS OR LESS | - 10 | t1 | - 17 | 30 | - 30 | 31 | - 33 | | 5 | 210 |
| | | 10~29 | - 10 | t1 | - 20 | 30 | - 30 | 31 | - 31 | | 5 | 210 |
| | | 30 SHEETS OR MORE | - 10 | t1 | - 21 | 30 | - 30 | 31 | - 31 | | 5 | 210 |
| | R-SIZED | 13 SHEETS OR LESS | - 10 | t2 | - 1 | 16 | - 30 | 7 | - 11 | | 5 | 210 |
| | | 14~39 | - 10 | t2 | - 1 | 14 | - 30 | 7 | - 8 | | 5 | 210 |
| | | 40 SHEETS OR MORE | - 10 | t2 | - 1 | 14 | - 30 | 7 | - 8 | | 5 | 210 |
| | SMALL-SIZED | 5 SHEETS OR LESS | - 10 | t2 | - 26 | 10 | - 10 | 12 | - 5 | | 5 | 210 |
| | | 6~13 | - 10 | t2 | - 1 | 16 | - 30 | 7 | - 11 | | 5 | 210 |
| | | 14~39 | - 10 | t2 | - 1 | 14 | - 30 | 7 | - 8 | | 5 | 210 |
| | | 40 SHEETS OR MORE | - 10 | t2 | - 1 | 14 | - 30 | 7 | - 8 | | 5 | 210 |
| THICK PAPER ALIGNMENT (USUAL) | LARGE-SIZED | | - 10 | t1 | - 21 | 31 | | | | | | |
| | R-SIZED | | - 10 | t2 | - 21 | 31 | | | | | | |
| | SMALL-SIZED | | - 10 | t2 | - 21 | 31 | | | | | | |
| THICK PAPER ALIGNMENT (LAST SHEET) | LARGE-SIZED | 9 SHEETS OR LESS | - 10 | t3 | - 17 | 30 | - 30 | 31 | - 33 | | 5 | 210 |
| | | 10~29 | - 10 | t3 | - 20 | 30 | - 30 | 31 | - 31 | | 5 | 210 |
| | | 30 SHEETS OR MORE | - 10 | t3 | - 21 | 30 | - 30 | 31 | - 31 | | 5 | 210 |
| | R-SIZED | 13 SHEETS OR LESS | - 10 | t4 | - 1 | 16 | - 30 | 7 | - 11 | | 5 | 210 |
| | | 14~39 | - 10 | t4 | - 1 | 14 | - 30 | 7 | - 10 | | 5 | 210 |
| | | 40 SHEETS OR MORE | - 10 | t4 | - 1 | 14 | - 30 | 7 | - 11 | | 5 | 210 |
| | SMALL-SIZED | 13 SHEETS OR LESS | - 10 | t4 | - 1 | 14 | - 30 | 7 | - 9 | | 5 | 210 |
| | | 14~39 | - 10 | t4 | - 1 | 14 | - 30 | 7 | - 10 | | 5 | 210 |
| | | 40 SHEETS OR MORE | - 10 | t4 | - 1 | 14 | - 30 | 7 | - 11 | | 5 | 210 |

SHEET FINISHER, IMAGE FORMING APPARATUS, AND SHEET CONVEYANCE APPARATUS

BACKGROUND OF THE INVENTION

This invention relates to a sheet finisher which receives sheets having an image formed on them in an image forming apparatus such as an electro-photographic copying machine, a printer, a facsimile apparatus, and a printing machine, and ejects them on to an output tray after applying a binding process by a binding means, to an image forming apparatus equipped with a sheet finisher, and to a sheet conveyance apparatus.

A sheet finisher which collates a plurality of sheets having an image formed on them ejected from an image forming apparatus and applies finish-processing by an finish-processing means such as a binding means are utilized.

The sheet finisher of this kind is functionally connected to an image forming apparatus such as a copying machine, a printer, and a facsimile apparatus, and is driven in accordance with the sequential operation of the copying or printing process.

Accordingly, for an image forming apparatus being capable of processing the image forming process at a high speed, it is required a sheet finisher being capable of high-speed processing which can perform the function in accordance with the process speed.

With respect to such a sheet finisher being capable of high-speed processing, it has already been disclosed in Tokkaisho 60-142359, Tokkaisho 60-158463, Tokkaisho 62-39169, Tokkaisho 62-288002, Tokkaisho 63-267667, Tokkaihei 2-276691 and Tokkouhei 5-41991.

In the above-described sheet finisher, sheets having an image formed on them conveyed out from the image forming apparatus mainframe are gripped and conveyed by a pair of conveyance rollers, and are successively stacked in an intermediate stacker while being collated, to be received as a bunch of sheets for one volume, and then they are subjected to an finish-processing by a stapler etc.; thus, the bunch of sheets subjected to the binding processing is then placed on an ejection belt provided at the bottom of the above-described intermediate stacker to be conveyed, and further it is gripped between an upper-and-lower pair of ejection rollers and ejected onto an output tray.

In Tokkaihei 9-235069, it is disclosed. to efficiently carry out the conveyance of sheets without stopping the sheet finisher during the interval for the transfer of operation from the finish-processing of the preceding bunch of sheets to the conveyance of the succeeding bunch of sheets, using a small-sized sheet finisher comprising a first sheet entry path for guiding a sheet conveyed out of an image forming apparatus, a second sheet entry path which diverges from said first sheet entry path at the upstream side and joins it at the downstream side, and a sheet conveyance means which makes the leading edge portions of the two sheets which have been conveyed through said first sheet entry path and second sheet entry path respectively get engaged with a conveyance roller pair to grip them in the overlapped state and then feeds them to the above-described intermediate stacker, wherein the first one of the succeeding sheets coming through the first sheet entry path is stopped by being engaged with the conveyance roller pair in still standing, the second sheet coming through the second sheet entry path is stopped to be on standby by being engaged with said conveyance roller pair in still standing in the state of being overlapped on the first sheet, and after the preceding bunch of sheets bound by a stapler is ejected from said intermediate stacker, the first one and the second one of the succeeding bunch of sheets are fed into said intermediate stacker at the same time as they are overlapped.

In order to convey two thick sheets in the state of being overlapped at the same time by a pair of conveyance rollers, a large conveying pressure is required, which makes the driving source large-sized too. If the initial sheet is conveyed out by this large conveying pressure and is made to strike against the outer circumferential surface of a conveyance roller located downstream, it produces problems such as roller contamination and the shortening of the roller life.

If the conveying pressure of the conveyance rollers is controlled to be varied, or a conveyance path is separately provided, the sheet finisher is made complex.

When the leading edge portions of the sheets conveyed by a conveyance means is made to strike against a stopper for truing up the leading edges and then the sheets are ejected into the above-described intermediate stacker, in order to improve the conveyance performance of the sheets, a wave-shaped deformation is formed in the direction parallel to the sheet conveying direction by conveyance rollers composed of a driving roller unit and a follower roller unit.

FIG. 17 shows a pair of conveyance rollers in a conventional sheet finisher; FIG. 17(*a*) shows the front view, and FIG. 17(*b*) shows the side cross-sectional view.

The rotary shaft RO of the aforesaid driving roller unit at the entrance of the intermediate stacker is supported in a manner capable of rotating by the apparatus mainframe, is connected to the driving source, and rotates for driving. To the rotary shaft R0, the driving roller members R1 having a circumferential surface made of an elastic rubber, and flange rollers R2 having an outer diameter larger than the outer diameter of the driving roller members R1 made of a hard material are fixed.

The flange rollers R2 carry it out to true up the leading edge portion of the sheets having been conveyed by the conveyance means by stopping them, and form a wave-shaped deformation in the sheets.

The follower rollers (pinch rollers) R3 of the follower roller unit are urged by the roller pressing springs sp, to make pressing contact with the driving roller members R1.

When a thick sheet is conveyed by the driving roller members R1 and the follower rollers R3 in the state of pressing contact with them, the urging spring force by the roller pressing springs sp must be set to a strong level. However, if a thin sheet is conveyed by this strong urging spring force, the sheet P is damaged.

It is an object of this invention to improve the conveying capability for a thick sheet without damaging a thin sheet.

In the case where sheets ejected from an image forming apparatus are brought in a conveyance path of the conveyance means of a sheet finisher and conveyed by conveyance rollers, during the bind-processing of the preceding bunch of sheets, if two sheets composed of the first one and the second one of the succeeding sheets are conveyed by conveyance rollers at the same time as the two sheets are overlapped, the waiting time for the bind-processing is shortened, which improves the processing speed.

However, if the conveyance of two sheets being overlapped is carried out, the truing-up performance of the sheets by the aligning operation will become worse because the two sheets are made in close contact with each other by the static electricity etc. Further, when the side edges of thick sheets in the width direction is trued up by the aligning plates of the aligning means, if the side edges of the thick sheets in the width direction are strongly pressed by the aligning plates, the stepping motor for driving the aligning plates goes out of tuning by the resisting force of the thick sheets, which lowers the sheet truing-up performance after that.

In a conventional sheet finisher, driving of the stapler has been done at the same measured timer value for a thick sheet and a thin sheet through measuring the passing of the trailing edge by a sheet passage sensor. However, for thick sheets having different conveyance characteristics from a usual sheet, dispersion in the sheet passage time from the sheet passage detecting sensor to the conveyance rollers at the entrance of the intermediate stacker is produced depending on the kinds of sheet.

Especially, with respect to sheets having a smooth surface and a high stiffness, the above-described sheet conveyance time becomes greatly prolonged, and the leading edge portion in the progressing direction of the last sheet can not reach the stopper near the stapler in the sheet conveying direction before the start of the bind-processing, to produce a deviation of the leading edge portion of the last sheet in the progressing direction.

In order to solve the above-described problems in the case of conveying thick sheets, if a uniformly prolonged sheet passage time in the sheet finisher FS is set, in the case of the conveyance of usual sheets, it cannot follow the sheet conveyance speed in the image forming apparatus, and the productivity of the processing in the image forming apparatus is lowered.

SUMMARY OF THE INVENTION

Accordingly, to overcome the abovementioned problems, a sheet conveyance apparatus and a sheet finisher, embodied in the present invention, will be described as follow:

(1) A sheet conveyance apparatus, comprising: a sheet conveyance path along which a sheet is conveyed; a first conveyance means for gripping and conveying said sheet along said sheet conveyance path; a gripping pressure change means for changing a gripping pressure of said first conveyance means; and a controller to control said gripping pressure change means in response to a thickness of said sheet gripped and conveyed by said first conveyance means.

(2) A sheet finisher, comprising: a conveyance means for conveying a sheet in a sheet conveying direction; an intermediate stacker to stack said sheet conveyed by said conveyance means; an aligning device to align sheets stacked on said intermediate stacker by pressing them in a direction perpendicular to said sheet conveying direction; a binder to bind a bunch of said sheets stacked and aligned on said intermediate stacker; an ejecting means for conveying and ejecting a bunch of said sheets bound by said binder; a drive means for driving said aligning device; a controller to control said drive means; and an overlapped sheets conveyance means for gripping and conveying two sheets, in which a succeeding sheet overlaps a previously conveyed sheet, so as to store them in said intermediate stacker, wherein said controller controls said drive means in a manner such that said aligning device aligns an initial one sheet stacked on said intermediate stacker under a first aligning condition, while said aligning device aligns two overlapped sheets, which are stacked on said intermediate stacker, under a second aligning condition.

(3) A sheet finisher, comprising: a conveyance means for conveying a sheet ejected from an image forming apparatus; an intermediate stacker to stack said sheet conveyed by said conveyance means; a binder to bind a bunch of said sheets stacked on said intermediate stacker; an ejecting means for conveying and ejecting a bunch of said sheets bound by said binder; a drive means for driving said conveyance means; a controller to controll said drive means; and a detector for detecting an end of said sheet passing through said conveyance means, wherein said controller controls said binder in a manner such that said binder binds a bunch of said sheets after a first predetermined time has passed since said detector detected an end of a final sheet included in a bunch of said sheets, serving as one file, while, when said controller determines that said conveyance means conveys thick sheets, said binder binds a bunch of said thick sheets after a second predetermined time, set by extending said first predetermined time, has passed since said detector detected an end of a final thick sheet included in a bunch of said thick sheets.

Further, to overcome the abovementioned problems, other sheet finisher and image forming apparatus, embodied in the present invention, will be described as follow:

(4) A sheet finisher, comprising: conveyance means for conveying sheets ejected from an image forming apparatus, an intermediate stacker for receiving a stack of the sheets conveyed by said conveyance means, binding means for carrying out bind-processing for a bunch of said stacked sheets received in said intermediate stacker, ejecting means for ejecting the bunch of sheets having been subjected to the bind-processing, drive means for driving said conveyance means, and control means for controlling the driving of said drive means, wherein said conveyance means comprises a second conveyance roller means for feeding the sheets in said intermediate stacker, a first conveyance roller means disposed at the upstream side of said second conveyance roller means in the conveying direction for conveying the sheets to said second conveyance roller means as gripping them in between, and a sheet guiding path for guiding the sheets conveyed from said first conveyance roller means to said second conveyance roller means, said first conveyance roller means is equipped with a gripping pressure change means for making it possible to change the gripping-pressing force of said first conveyance roller means, and said control means carries out a control so as to make it possible to convey a plurality of sheets overlapped on one another at the same time by said first conveyance roller means and said second conveyance roller means and change the gripping-pressing force for the sheets conveyed by said first conveyance roller means.

(5) A sheet finisher, comprising: conveyance means for conveying sheets ejected from an image forming apparatus an intermediate stacker for receiving a stack of the sheets conveyed by said conveyance means, binding means for carrying out bind-processing for a bunch of said stacked sheets received in said intermediate stacker, ejecting means for ejecting the bunch of sheets having been subjected to the bind-processing, drive means for driving said-conveyance means, and control means for controlling the driving of said drive means, wherein said conveyance means comprises a second conveyance roller means for feeding the sheets in said intermediate stacker, a first conveyance roller means disposed at the upstream side of said second conveyance roller means in the conveying direction for conveying the sheets to said second conveyance roller means as gripping them in between, and a sheet guiding path for guiding the sheets conveyed from said first conveyance roller means to said second conveyance roller means, and said control means carries out a control so as to make it possible to convey a plurality of sheets overlapped on one another at the same time by said first conveyance roller means and said second conveyance roller means and prohibit the conveyance of two sheets being overlapped in the case where it is set to the thick sheet.

(6) A sheet finisher, which conveys sheets ejected from an image forming apparatus by a conveyance means, receives a stack of the sheets in an intermediate stacker, carries out bind-processing by a binding means, and then ejects the sheets by an ejecting means, wherein said conveyance means comprises a first conveyance roller means for conveying the sheets as gripping them in between, a second conveyance roller means disposed at the downstream side of said first conveyance roller means in the conveying direction for conveying the sheets to said intermediate stacker, a pair of guide members facing to each other which form a sheet conveyance path between said first conveyance roller means and said second conveyance roller means, a guiding portion provided in said guide members in a projecting manner so as to make a part of said sheet conveyance path form a path having a minimum spacing capable of letting the sheets pass through, and a pressing-contact releasing means for releasing the pressing contact of the follower roller which is pressed to get contact with the driving roller of said first conveyance roller means, and when said pressing-contact releasing means releases the pressing contact of the follower roller which is pressed to get contact with the driving roller of said first conveyance roller means, the guiding portion provided in said guide members presses the sheets to the follower roller side, to make the sheet conveyance possible.

(7) A sheet finisher comprising: conveyance means for conveying sheets ejected from an image forming apparatus conveyance roller means composed of a drive conveyance roller and a driven conveyance roller for ejecting the sheets conveyed by said conveyance means onto an intermediate stacker after stopping the sheets for truing up the leading edges, and binding means for carrying out bind-processing for a bunch of sheets stacked in said intermediate stacker, said drive conveyance roller being composed of a rotary shaft connected to a drive source, driving roller members which are fixed to said rotary shaft and are pressed to the follower roller members of said driven conveyance roller, a hard flange members which are fixed to said rotary shaft and located close to one side of said driving roller members in the direction of the rotary shaft respectively, and elastic flange members which are fixed to said rotary shaft and located close to the other side of said driving roller members in the direction of the rotary shaft respectively, said sheet finisher conveying the sheets by the rotation of said drive conveyance roller and said driven conveyance roller as gripping them between the rollers, forming a wave-shaped deformation parallel to the conveying direction in the sheets.

(8) An image forming apparatus, which is equipped with a sheet finisher set forth in any one of the above-described paragraphs (4) to (7).

(9) A sheet finisher, comprising: a conveyance roller means for conveying sheets, wherein said conveyance roller means comprises conveyance rollers and a gripping pressure change means for changing the pressing force of said conveyance rollers for gripping the sheets in between, and said gripping pressure change means comprises a plate spring, an oscillation driving member, oscillation receiving member, and a solenoid, and makes the pressing force of said conveyance rollers able to be changed in accordance with the thickness of the sheets recognized by a recognizing means for recognizing the thickness of the sheets.

(10) A sheet finisher, comprising: conveyance means for conveying sheets, an intermediate stacker for stacking the sheets conveyed, aligning means for aligning the sheets stacked on said intermediate stacker by pressing them in the direction perpendicular to the sheet conveying direction, binding means for carrying out bind-processing for a bunch of the sheets stacked on said intermediate stacker and aligned by it, ejecting means for conveying and ejecting the bunch of sheets having been subjected to the bind-processing, drive means for driving said aligning means, and control means for controlling said drive means, where in said control means controls said drive means for driving said aligning means in a manner such that the alignment of the sheets is carried out, in the first alignment condition in the case where the alignment is made for a predetermined number of sheets (or less) stacked on said intermediate stacker, and in the third alignment condition in the case where the alignment is made for a number of sheets exceeding the predetermined number.

(11) An image forming apparatus, equipped with the sheet finisher set forth in the above-described paragraph (10).

BRIEF DESCRIPTION OF THE DRAWINGS

Other objectives and advantages of the present invention will become apparent upon reading the following detailed description and upon reference to the drawings in which:

FIG. 20 is a schematic drawing showing the operation of the width aligning means;

FIG. 21 is a timing chart showing the movement of the width aligning members;

DETAILED DESCRIPTION OF THE PREFERRED EMBODIMENT

In the following, a sheet finisher of this invention and an image forming apparatus equipped with the sheet finisher will be explained with reference to the attached drawings.

Figure 1:
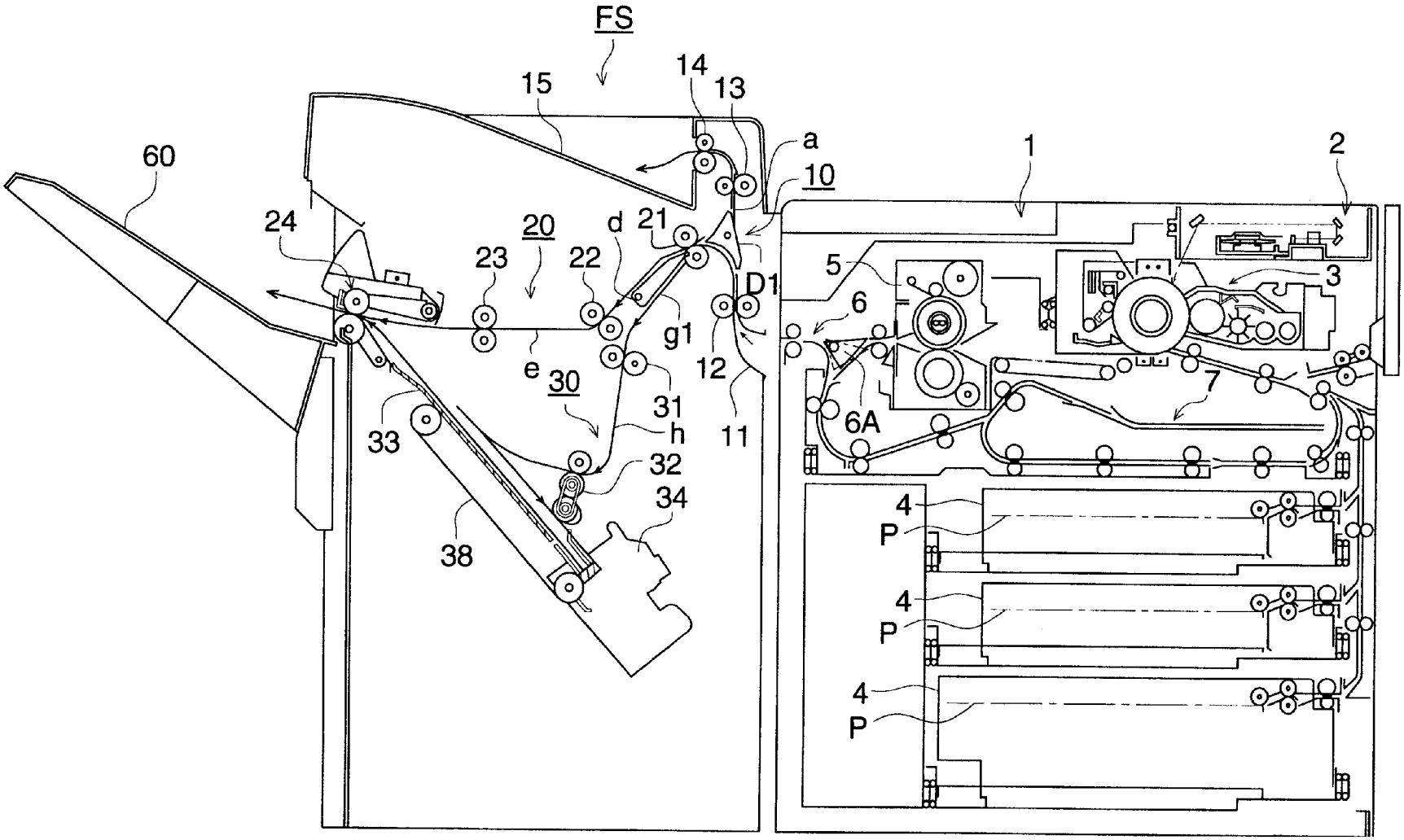
FIG. 1 is a drawing showing the overall structure of an image forming system equipped with an image forming apparatus and a sheet finisher.

FIG. 1 is a drawing showing the overall structure of an image forming apparatus equipped with the image forming apparatus A and the sheet finisher FS.

The image forming apparatus mainframe A shown in the drawing is equipped with the image processing means 1, the image writing means 2, the image forming means 3, the cassette sheet feeding means 4, the fixing means 5, the ejecting means of the mainframe 6, and the automatic duplex conveyance means (ADU) 7. The sheet finisher FS is connected to the side of the sheet ejecting means of the mainframe 6 at the left side in the drawing of the image forming apparatus mainframe A.

In the image writing means 2, the output light from a semiconductor laser is applied to the photoreceptor drum of the image forming means 3, to form a latent image. In the image forming means 3, the processes such as charging, exposure development, transfer, detaching, and cleaning are carried out, and an image is transferred to the sheet P which is conveyed from the cassette sheet feeding means 4. The sheet P carrying an image is fixed by the fixing means 5, and is conveyed from the sheet ejecting means of the mainframe into the sheet finisher FS.

In other way, the sheet P having an image already processed on one side fed into the automatic duplex conveyance means 7 by the conveyance path switching plate 6A is again subjected to the image processing for duplex in the image forming means 3, and then it is conveyed from the sheet ejecting means of the mainframe 6 into the receiving portion 11 of the sheet finisher FS.

The sheet conveyance pathway in the sheet finisher FS are composed of the following first conveyance pathway to the third conveyance pathway.

(1) The first conveyance pathway 10: the conveyance pathway approximately in the vertical direction at the right side in the drawing from the receiving portion 11 through the entrance rollers 12, the path a at the right side of the switching gate D1, and the path b to the ejecting rollers 14.

(2) The second conveyance pathway 20: the conveyance pathway for successive single sheet ejection or shift ejection starting from the path c at the obliquely lower side of the switching gate D1, through the conveyance rollers 21, the path d at the upper side of the switching gate D2, the conveyance rollers 22, the path e, and the conveyance rollers 23, ending at the ejecting means 24.

(3) The third conveyance pathway 30: conveyance pathway for bind-processing diverging from the second conveyance pathway at the conveyance rollers 21 through the path g1 at the obliquely lower side of the switching gate D3 (or the path g2), the first conveyance roller means 31, the path h, the second conveyance roller means 32, the intermediate stacker 33, and the ejecting belt 38 up to the ejecting means 24.

Figure 2:
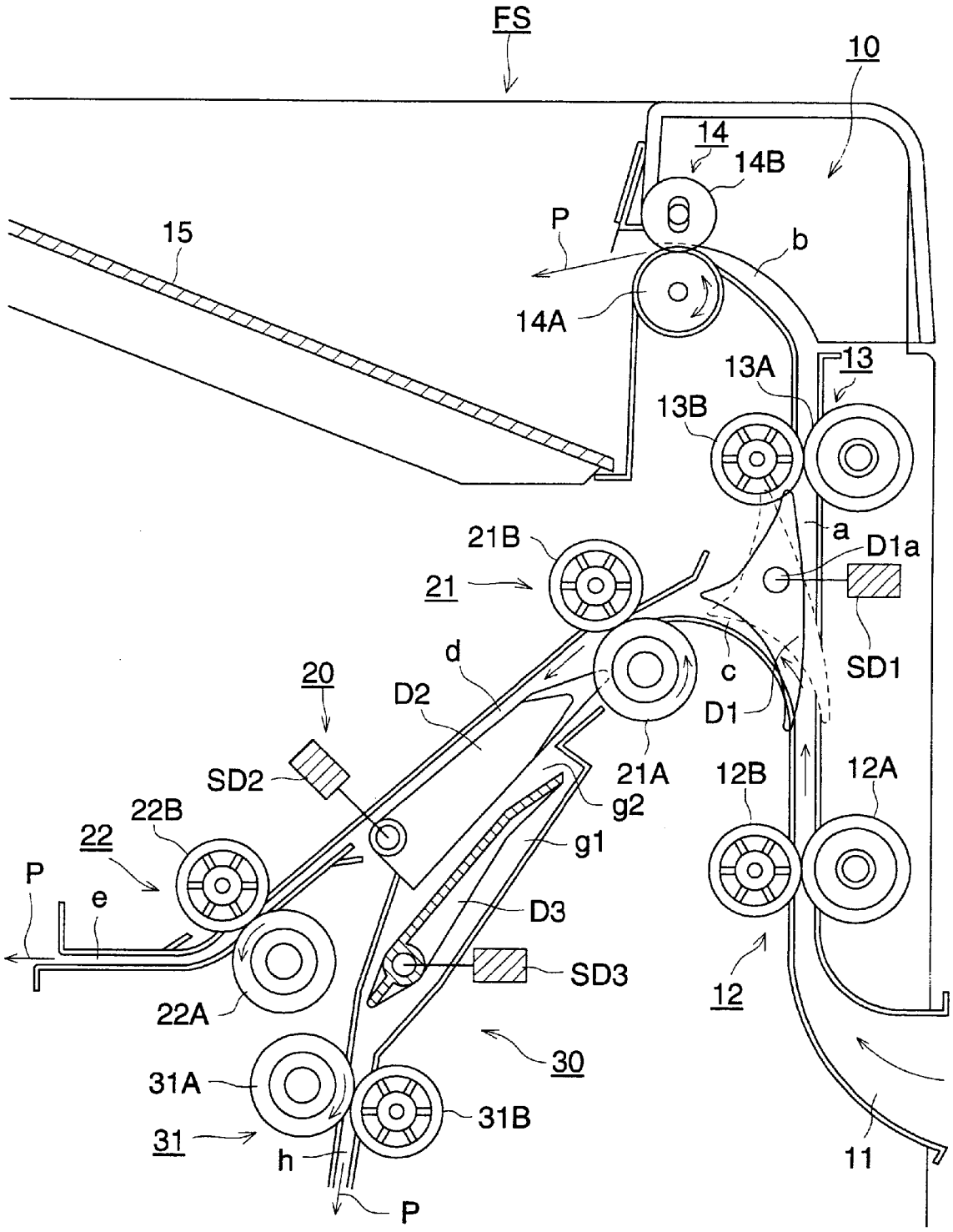
FIG. 2 is a cross-sectional view of the sheet conveyance section of a sheet finisher.
Figure 3:
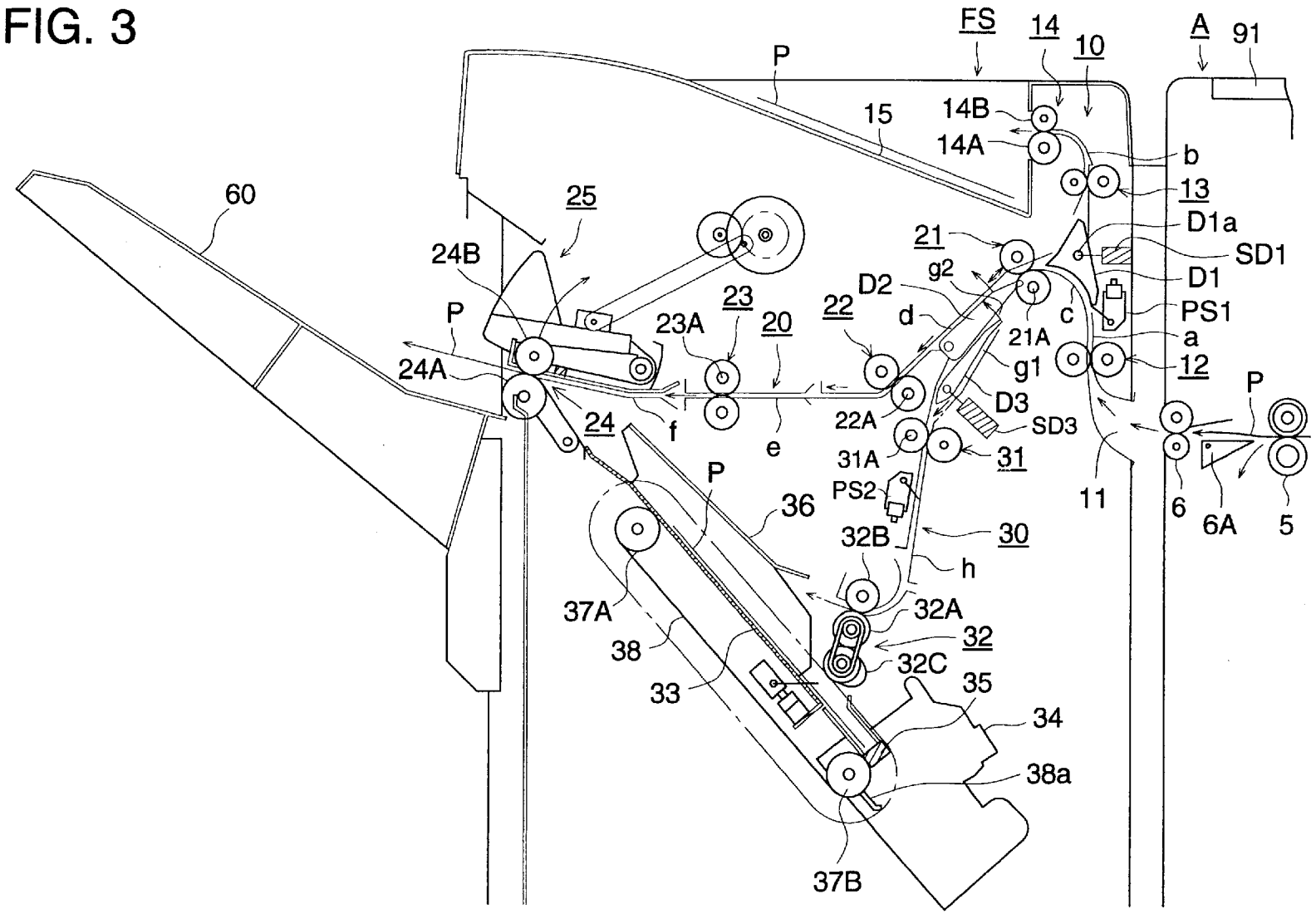
FIG. 3 is a cross-sectional view showing the structure of a sheet finisher.

FIG. 2 and FIG. 3 are detailed cross-sectional views of the portion in the neighborhood of the bifurcating portion of the sheet conveyance pathway in the sheet finisher FS.

In the case where sheet finish-processing is not carried out, the sheet P having an image already formed on it ejected from the image forming apparatus mainframe A is brought in the receiving portion 11 of the first conveyance pathway 10, is conveyed by the entrance rollers 12 composed of the driving roller 12A and the follower roller 12B, passing through the path a at the right side of the switching gate D1 located upward, is further conveyed by the conveyance rollers 13 composed of the driving roller 13A and the follower roller 13B as being gripped in between, passing through the path b located upward, and is ejected onto the output tray 15 on the upper side of the sheet finisher after it is gripped between the ejecting rollers 14 composed of the driving roller 14A and the follower roller 14B.

If the shift mode in which the position of the ejected sheet is shifted for separation or the non-sort mode in which sorting of the sheets is not carried out is set in the operation section 91 of the image forming apparatus mainframe, the switching gate D1 is oscillated around the shaft D1*a* by the driving of the solenoid SD1, is stopped at the position shown by the broken line in the drawing, and closes the path a, while bringing the path c in the open state.

The sheet P having an image already formed on it ejected from the image forming apparatus mainframe A passes the receiving portion 11 of the first conveyance pathway 10, and the entrance rollers 12, enters the second conveyance pathway 20, passing through the pathway c formed in the open state under the switching gate D1, is gripped between the conveyance rollers 21 of the second conveyance pathway 20 composed of the driving roller 21A and the follower roller 21B, passing through the path d over the switching gate D2, is gripped between the conveyance rollers 22 composed of the driving roller 22A and the follower roller 22B, passing through the path e, is gripped between the conveyance rollers 23, further passing through the path f, and is ejected and placed by the ejecting roller 24 composed of the lower roller 24A and the upper roller 24B onto the up-and-down moving sheet output tray 60 located outside the sheet finisher. Numeral 25 denotes the oscillating means for oscillating the upper roller 24B.

If the bind-processing mode is set in the operation section 91 of the image forming apparatus mainframe, the sheet P having an image already formed on it ejected from the image forming apparatus mainframe A passes the receiving portion 11 of the first conveyance pathway 10 and the entrance rollers 12, enters the second conveyance pathway 20, passing through the path c, is gripped between the conveyance rollers 21, passing through the path g1 (or the path g2) under the switching gate D2 located obliquely downward in the third conveyance pathway 30, is gripped between the conveyance rollers 31 composed of the driving roller 31A and the follower roller 31B, passing through the path h, is gripped between the conveyance rollers 32 composed of the driving roller 32A and the follower roller 32B, and is ejected onto the intermediate stacker 33 which is disposed in a tilted position, where the sheets is stopped with its trailing edge made in contact with the sheet stopping member 35 (hereinafter referred to as the stopper 35).

Numeral 36 denotes a pair of aligning members provided at the both sides of the intermediate stacker 33 in such a manner as to be capable of moving, and makes the alignment of a bunch of sheets in the width direction by tapping the side edges of the sheets P in the width direction.

When a predetermined number of sheets P are stacked and aligned on the intermediate stacker 33, bind-processing is carried out by the stapler 50, serving as a binding means, and a bunch of the sheets are processed to be bound.

A notch portion is formed at a part of the sheet stacking surface of the intermediate stacker 33, and a plurality of ejection belts 38 are entrained around the drive pulley 37A and the driven pulley 37B in such a manner as to be capable of revolution and are driven.

At a part of t he ejection belts 38, the ejection fingers 38*a* are integrally formed respectively and their end portions draw loci of elongated circle as shown by the single dot and dash line. The sheets P having been subjected to the bind-processing, with their trailing edges held by the ejection fingers 38*a* of the ejection belts 38, are pushed obliquely upward by the revolving ejection belts 38, and progress to the ejecting rollers 24 composed of the lower roller 24A and the upper roller 24B. The bunch of sheets P gripped between the rotating ejecting rollers 24 is ejected and stacked on the up-and-down moving sheet output tray 60.

Figure 4:
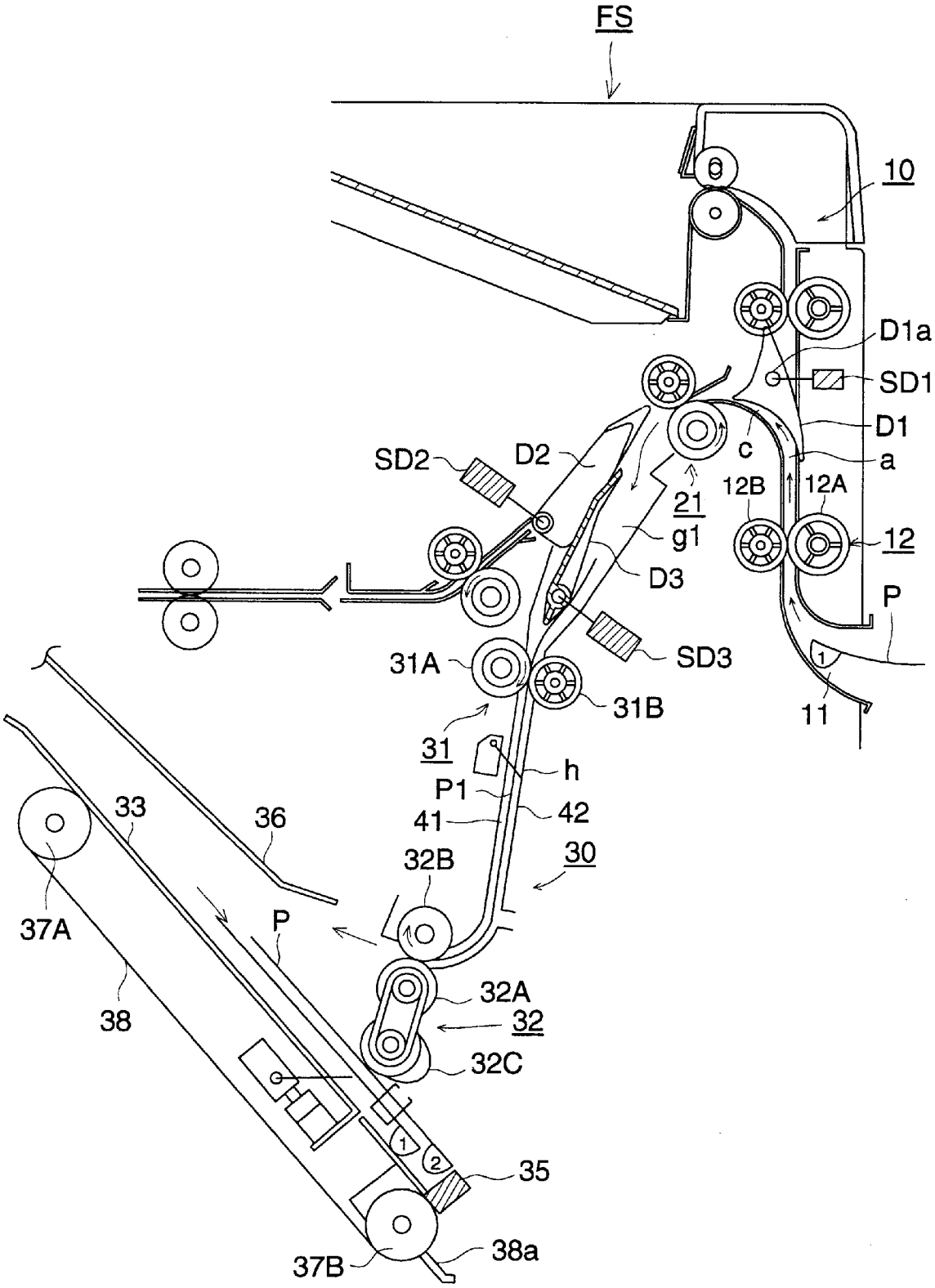
FIG. 4 is a cross-sectional view showing the situation in which a first small-sized sheet passes through the path in the third conveyance pathway.

FIG. 4 is a cross-sectional view showing the conveyance pathway of the first sheet P1.

In the case where sheets are bunched and processed to be bound, the solenoid SD2 is actuated to repel upward the end portion of the switching gate D3, to make the sheet P1 able to pass by opening the path g1 while intercepting the path g2.

When the bind-processing for the small-sized sheets is set, the solenoid SD2 is actuated to repel upward the end portion of the switching gate D2, which is a switching means of the sheet conveyance direction, to intercept the path d. Next, the solenoid SD3 is actuated to repel upward the end portion of the switching gate D3, to make the sheet P1 able to pass by opening the path g1 while intercepting the path. g2.

The first sheet P1, which has been fed in the path g1 by being gripped between the conveyance rollers 21, passes the path g1, passes the path h while being gripped between the first conveyance roller means 31, and is stopped by it that the leading edge portion of the sheet has got in contact with the outer circumferential roller surface in the neighborhood of the nip position of the drive conveyance roller 32A and the driven conveyance roller 32B of the second conveyance roller means 32 which are in the still standing state. In this stopped state of the sheet, the trailing edge portion of the sheet P1 remains in the path g1, to make it possible to prevent the interference with the leading edge portion of the succeeding second sheet P2.

Figure 5:
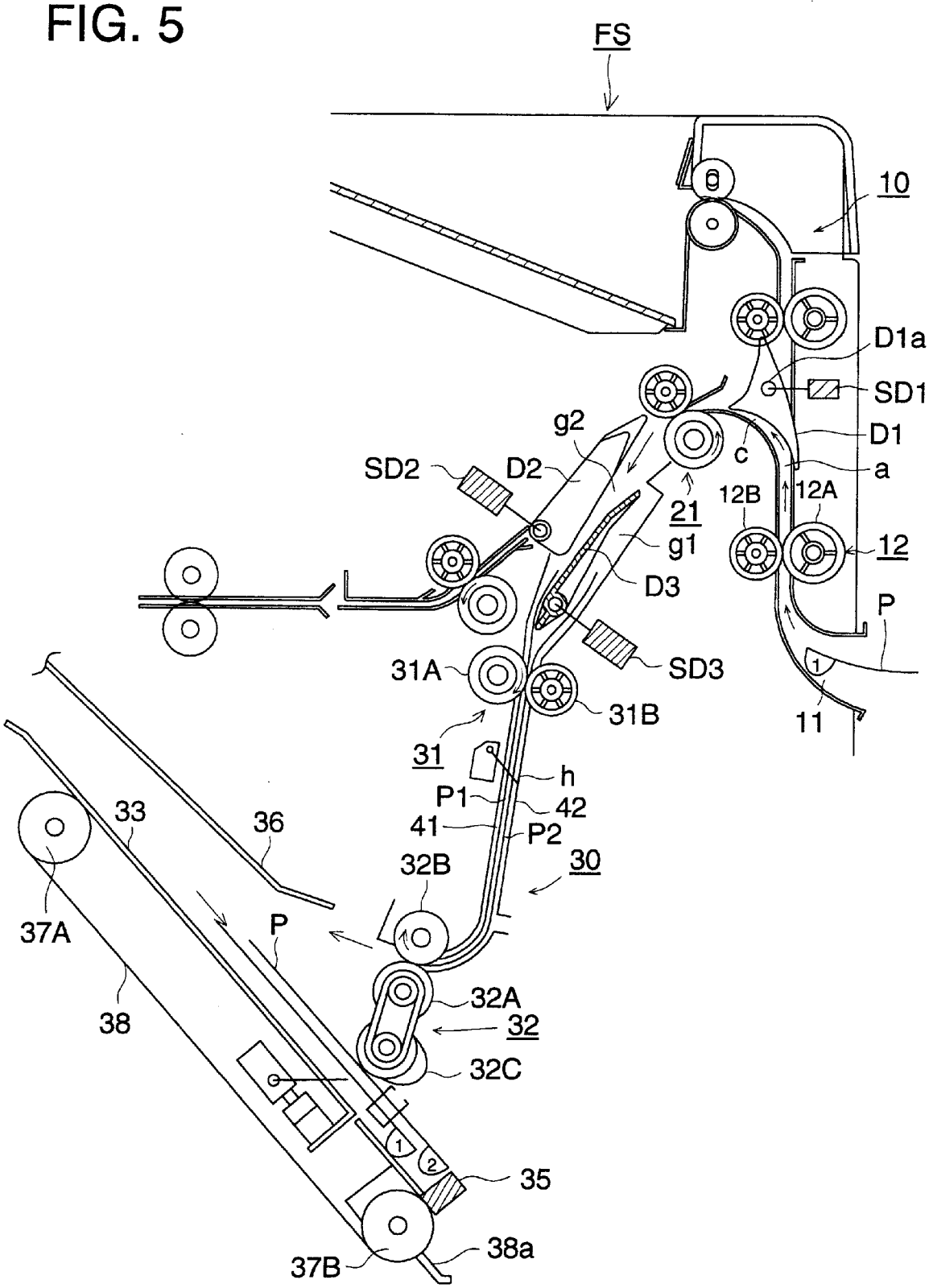
FIG. 5 is a cross-sectional view showing the situation in which a second small-sized sheet passes through the path in the third conveyance pathway.

FIG. 5 is a cross-sectional view showing the conveyance pathway of the second sheet P2.

Before the leading edge portion of the second sheet P2 pass through the conveyance rollers 21, the solenoid SD3 is actuated to oscillate downward the end portion of the switching gate D3, to make the sheet P2 able to pass by opening the path g2 while intercepting the path g1.

The sheet P2 passes the path g2, passes the path h while being gripped by the first conveyance roller means 31, and is stopped by it that the leading edge portion of the sheet has got in contact with the outer circumferential roller surface in the neighborhood of the nip position of the driving conveyance roller 32A and the follwer conveyance roller 32B of the second conveyance roller means 32 which are in the still standing state. Accordingly, the sheets P1 and P2 are received in the path h in the overlapped state, and each of the leading edge portions of the sheets P1 and P2 is in contact with the roller outer circumferential surface of the second conveyance roller means 32 and is stopped.

After the preceding bunch of sheets which has been processed to be stapled is ejected by the ejection belts 38, the first sheet P1 and the second sheet P2, which makes the succeeding bunch of sheets, are gripped in the overlapped state by the second conveyance roller means 32 at the same time, and are ejected onto the intermediate stacker 33.

Figure 6:
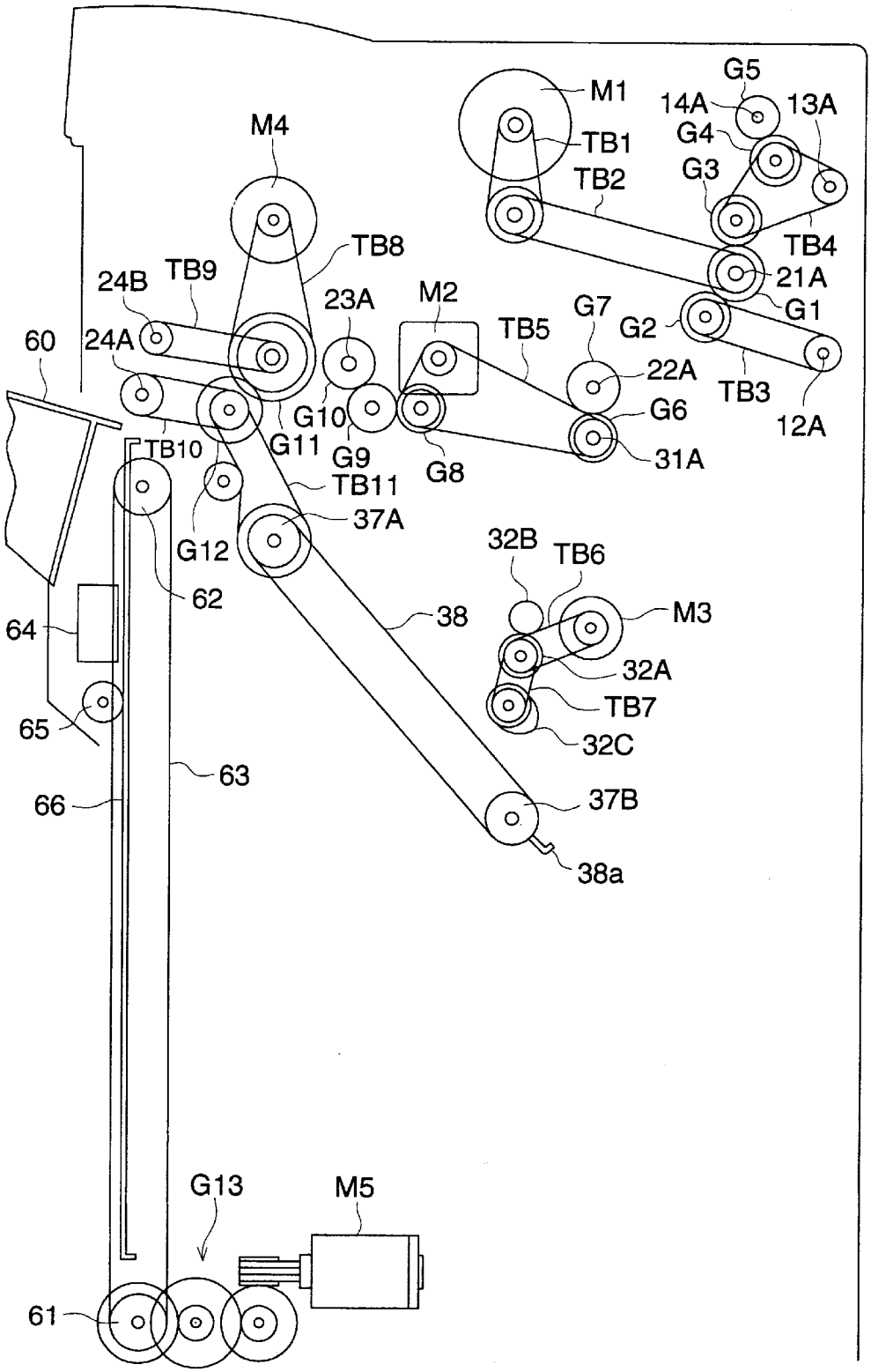
FIG. 6 is a drawing showing the structure of the motor driving means of a sheet finisher.

FIG. 6 is a drawing showing the structure of the motor driving means of the sheet finisher.

The drive motor M1 rotates the driving roller 21A of the conveyance rollers 21 through the timing belts TB1 and TB2. The gear G1, which is fixed on the shaft of the driving roller 21A rotates the driving roller 12A of the entrance rollers 12 through the gear G2 and the timing belt TB3. Further, the gear G1 rotates the driving roller 13A of the conveyance rollers 13 through the gear G3 and the timing belt TB4.

The gear G4, which is fixed to the shaft of the intermediate pulley around which the timing belt TB4 is entrained, meshes with the gear G5, and rotates the driving roller 14A of the ejecting rollers 14.

The drive motor M2 rotates the driving roller 31A of the first conveyance roller means 31 through the timing belt TB5. The gear G6, which is fixed to the shaft of the driving roller 31A, rotates the driving roller 22A of the conveyance rollers 22 through the gear G7. Further, the timing belt TB5 rotates the driving roller 23A of the conveyance rollers 23 through the gear train composed of the gears G8, G9, and G10.

The drive motor M3 drives to rotate the driving conveyance roller 32A of the second conveyance roller means 32 through the timing belt TB6. The follower conveyance roller 32B is pressed to be in contact with the driving conveyance roller 32A to be driven to rotate, to grip and convey the sheet P with the driving conveyance roller 32A. The driving conveyance roller 32A rotates the rotary member for assisting conveyance 32C through the timing belt TB7.

The drive motor M4 rotates the upper roller member 24B of the ejecting rollers 24 through the timing belts TB8 and TB9, while it rotates the lower roller member 24A through the gears G11 and G12 and the timing belt TB10. Further, the intermediate pulley, which drives the lower roller member 24A, rotates the drive pulley 37A through the timing belt TB11, to revolve the ejection belts 38.

The drive motor M5 drives to rotate the drive pulley 61 through the gear train G13, to revolve the wire 63, which is entrained around the drive pulley 61 and the driven pulley 62 upward. At a part of the wire 63, the base portion of the up-and-down moving sheet output tray 60 is fixed by the engaging member 64. The up-and-down moving sheet output tray 60 is capable of moving up and down along the rail member 66, by the rotation of the wire 63, which is initiated through the rolling motion along the rail member 66 of the roller 65 which is supported at the base portion of the sheet output tray 60 in a rotatable way.

Figure 7:
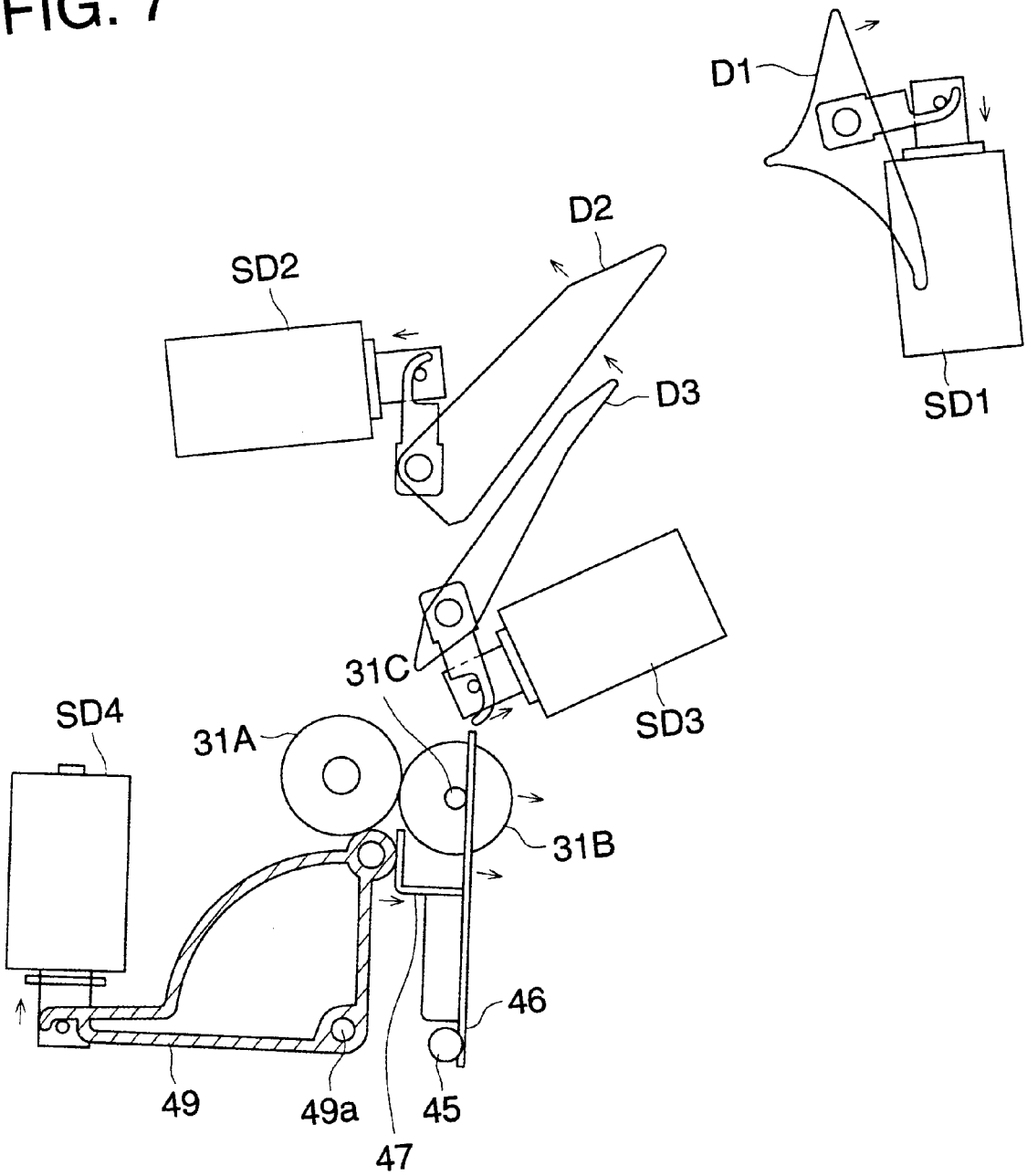
FIG. 7 is a drawing showing the structure of the solenoid driving means.

FIG. 7 is a drawing showing the structure of the solenoid driving means.

The solenoid SD1, the solenoid SD2 and the solenoid SD3 drive the switching gate D1; the switching gate D2 and the switching gate D3, respectively, in such a manner as to oscillate them, to switch over the conveyance pathway of the sheet P. The solenoid SD4 switches over the pressing force of the follower roller 31B, which presses the driving roller 31A to get in contact with it, between a strong level and a weak level.

(The First Embodiment)

Figure 8:
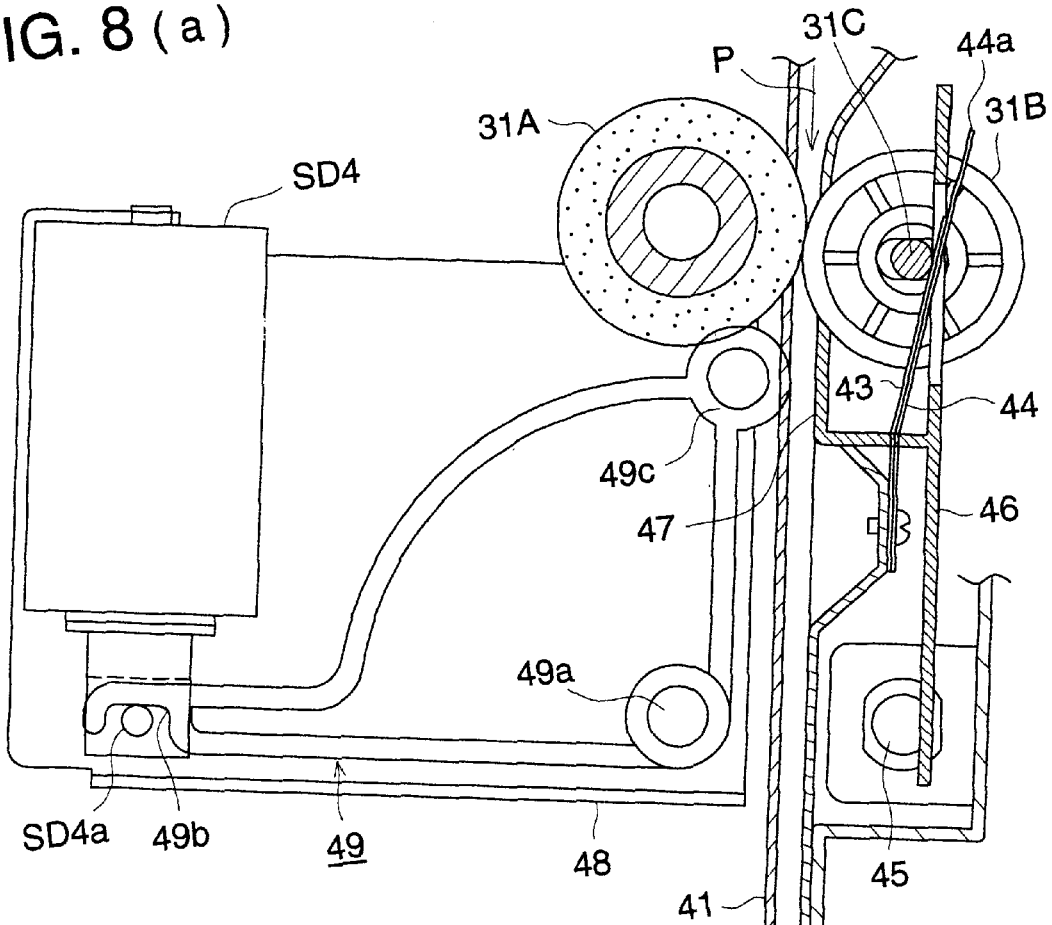
FIG. 8(*a*) is a cross-sectional view of the gripping pressure change means of the follower roller which is pressed to get contact with the driving roller, and FIG. 8 (*b*) is an enlarged cross-sectional view of the essential portion.
Figure 8:
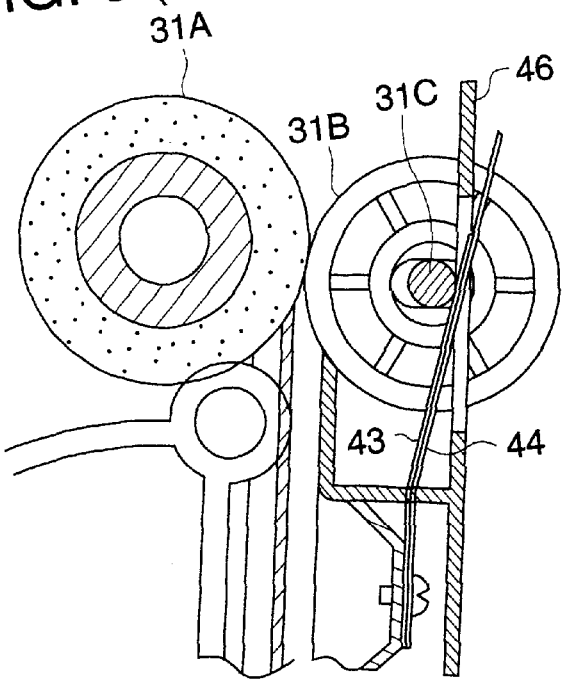
Figure 9:
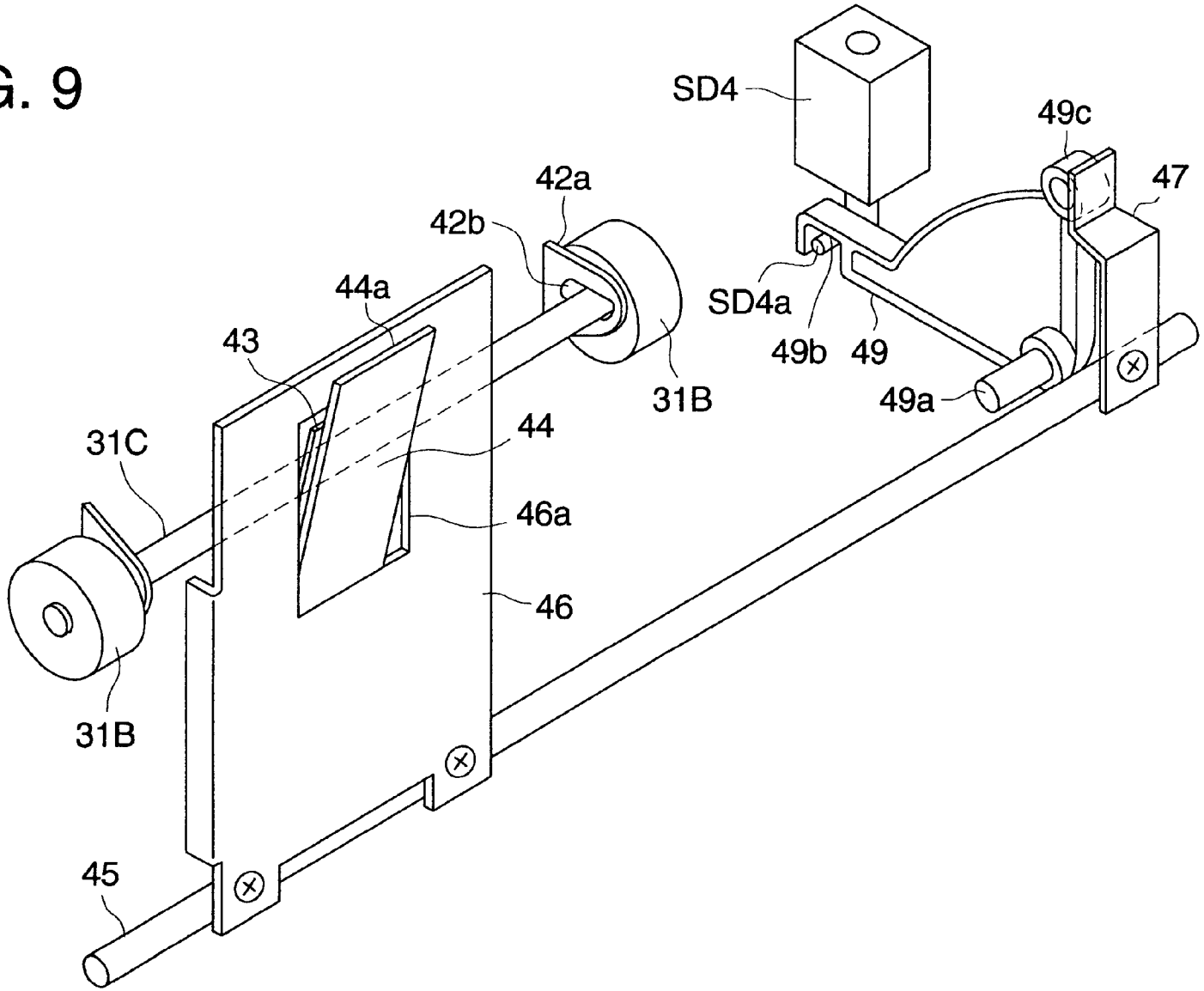
FIG. 9 is a perspective view of the gripping pressure change means.
Figure 10:
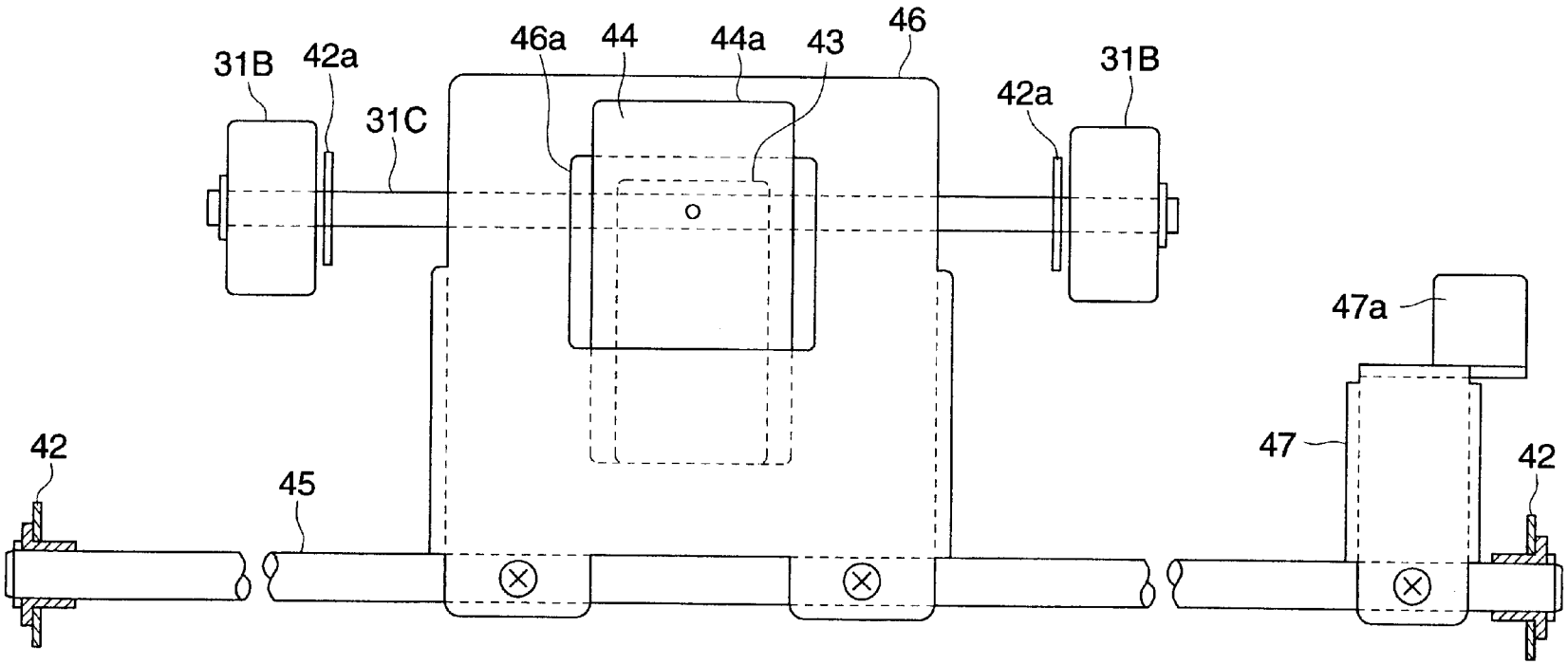
FIG. 10 is the side view of the gripping pressure change means.

FIG. 8(*a*) is a cross-sectional view of the gripping pressure change means for the follower roller 31B which presses the driving roller 31A to get in contact with it, FIG. 8(*b*) is an enlarged cross-sectional view of it, FIG. 9 is a perspective view of the gripping pressure change means, and FIG. 10 is the side view of the gripping pressure change means.

The sheet P passing through the nip position between the driving roller 31A made of an elastic rubber such as an ethylene-propylene rubber (EPDM) and the follower roller 31B made of a hard resin such as a poly-acetal (POM) passes the inside of the path h which is formed by the fixed guide plate 41 fixed to the apparatus mainframe and the movable guide plate 42 supported in a manner capable of opening and closing, which are kept parallel at a predetermined spacing.

The movable guide plate 42 is usually held integrally with the fixed guide plate 41, makes it possible for the sheet to pass through, and also makes it possible to take out the sheet in the path h owing to a poor conveying at the time of disposing of a sheet jam.

The elongated circle hole portions 42*b*, which are provided by boring at the cut-and-bent portions 42*a* formed at two positions of the movable guide plate 42, support the shaft 31C of the follower roller 31B in a manner capable of moving.

In a part of the movable guide plate 42, one end of each of the two plate springs 43 and 44 is fixed being overlapped each other and is supported by the end. The plate springs 43 and 44 are made of thin stainless steel plates respectively, and their free end portions presses the central portion in the axial direction of the shaft 31C of the follower conveyance roller 31B to give a spring pressure.

The spring pressure of the plate spring 43 is set to an optimum pressing force for feeding the first sheet P1 and the second sheet P2 overlapped each other. The spring pressure of the plate spring 44 is set to an optimum pressing force for conveying a thick sheet, and is larger than the spring pressure of the plate spring 43.

The oscillating shaft 45 is supported on the movable guide plate 42 in a manner rotatable around its axis. Near the central portion of the oscillating shaft, the base portion of the oscillating member 46 is fixed by a screw. Near the upper portion of the oscillating member 46, the rectangular window portion 46*a* is provided as bored and the end portion 44*a* of the plate spring 44 projects out of it. Near the one end of the oscillating shaft 45, the oscillation receiving member 47 is fixed.

The base plate 48 is fixed to the fixed guide plate. On the base plate 48, the solenoid SD4 and the oscillation driving member 49 are disposed. The oscillation driving member 49 is capable of oscillating around the shaft 49*a*. The engaging portion 49*b* at one end of the oscillation driving member 49 engages with the plunger pin SD4*a* of the solenoid SD4 urged by a spring. The pressing portion 49*c* at the other end of the oscillation driving member 49 is to get in contact with the oscillation receiving member 47.

After sheets having an image already formed on them is fed from the image forming apparatus mainframe A to the sheet finisher FS, while a first bunch of sheets is processed to be stapled on the intermediate stacker 33, the first sheet P1 and the second sheet P2, which make the succeeding second bunch of sheets, are gripped by the first conveyance roller means 31 and are on standby.

When these sheets P1 and P2 are set to the thick sheet (for example, the basis weight of about 200 g/m$^2$), the solenoid SD1 is held off and does not work, the oscillation driving member 49 and the oscillation member 46 are kept at their initial positions, and the two plate springs 43 and 44 in the overlapped state presses strongly the shaft 31C of the follower roller 31B. Accordingly, a combined force by the two spring plates 43 and 44 is applied to the follower roller 31B, to press the driving roller 31A strongly.

Because the path h is curved as shown in FIG. 4 and FIG. 5, a large pressing force is required for the first conveyance roller means 31, which is supposed to grip and convey the thick sheet P having a high stiffness. Especially, in the case where the sheets P1 and P2 are both thick ones, a larger pressing force is required. This strong pressing force is obtained from the combined pressure by the two spring plates 43 and 44.

Further, this strong pressing force by the two spring plates 43 and 44 is applied to the case where overlapped two sheets of thick sheet are conveyed, to the case where a thick sheet is conveyed, to the case where a sheet of usual sheet (for example, a sheet having a basis weight in the range from 60 to 90 g/m$^2$), and so forth.

However, in the case where two overlapped usual sheets which has a weak stiffness are conveyed, it is necessary to weaken the pressing force of the first conveyance roller means 31 in order that the following problems should not be produced.

(1) When the leading edge of a sheet is made to strike against the outer circumferential surface of the second conveyance roller means 32 at the downstream side, if the pressing force by the first conveyance roller means 31 is strong, the leading edge portion of the sheet is made to strongly strike against the outer circumferential surface of the second conveyance roller means 32, to be crushed.

(2) force by the first conveyance roller means 31 is strong, a sheet of usual sheet gripped between the driving roller 31A made of an elastic material and the follower roller 31B made of a hard resin meshes with the elastic material to produce creases.

(3) Owing to the strong pressing force, smudging by the sheet powders etc. is produced on the elastic material of the first conveyance roller means 31.

Figure 11:
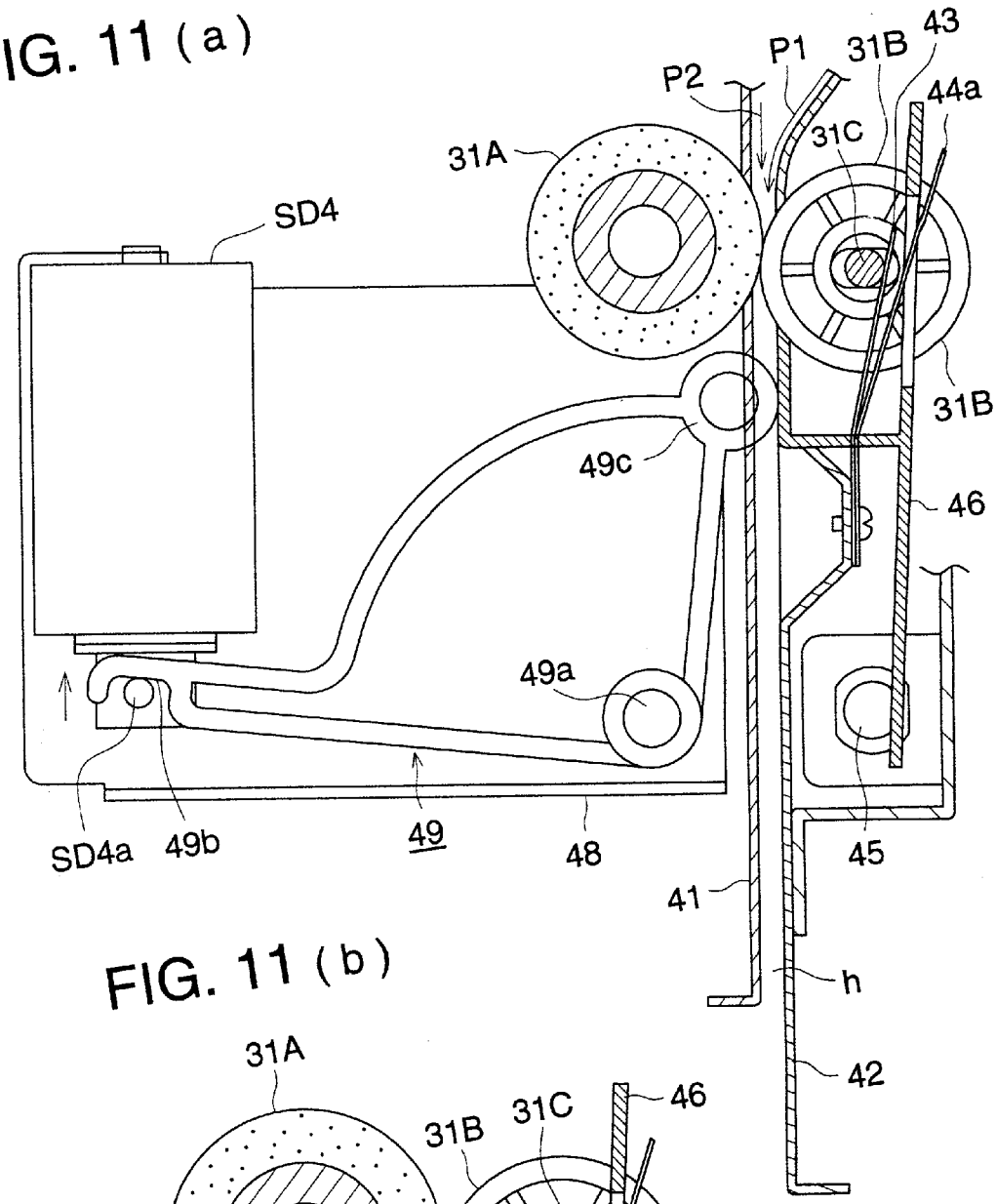
FIG. 11(*a*) is a cross-sectional view of the gripping pressure change means at the time of conveying two overlapped usual sheets, and FIG. 11(*b*) is an enlarged cross-sectional view of the essential portion.
Figure 11:
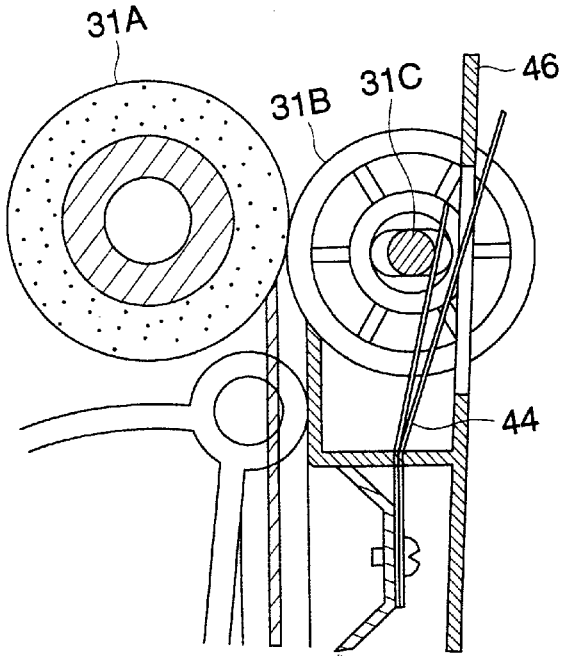

FIG. 11 is a cross-sectional view of the gripping pressure change means at the time of conveying two overlapped usual sheets by the first conveyance roller means 31.

In the process where a preceding bunch of sheets is processed to be bound on the intermediate stacker and ejected from it, a succeeding bunch of sheets is required not to be conveyed and to be on standby. For this reason, productivity in copying is lowered.

In order to reduce this standby time to improve the copy productivity, a conveyance mode for conveying overlapped two sheets is set. That is, the first sheets P1 of the succeeding bunch of sheets is stopped at the standby position at this side of the second conveyance roller means 32. Successively, the second sheets P2 is conveyed to the above mentioned standby position, and is stopped to be in the state of being overlapped on the first sheets P1.

After the binding process for the preceding bunch of sheets has been finished and the bunch is ejected from the intermediate stacker 33, the first sheet P1 and the second sheets P2, which make the succeeding bunch of sheets, are conveyed in the overlapped condition simultaneously onto the intermediate stacker 33 by the second conveyance roller means 32.

When the mode is set in which the first sheets (usual sheet) P1 and the second sheets (usual sheet) P2 are conveyed in the overlapped condition, the solenoid SD4 is actuated to attract the plunger pin SD4*a*, which presses the engaging portion 49*b* at one end of the oscillation driving member 49, to oscillate the oscillation driving member 49 around the shaft 49*a* in the clockwise direction as shown in the drawing.

The pressing portion 49*c* presses the oscillation receiving member 47 through the oscillation of the oscillation driving means 49, to oscillate the oscillating shaft 45 and the oscillating member 46 in the clockwise direction as shown in the drawing.

The upper edge of the rectangular window portion 46*a* of the oscillating member 46 presses the free end portion 44*a* of the plate spring 44 through the oscillation of the oscillating member 46, to detach the end portion 44*a* from the plate spring 43 compulsorily. In this state, because only the pressing force of the plate spring 43 acts on the shaft 31C of the follower roller 31B, the follower roller 31B presses the driving roller 31A with a weak pressing force.

The first sheet P1 passes through the nip position of the driving roller 31A and the follower roller 31B, which are lightly pressed by the plate spring 43, and is conveyed to the second conveyance roller means 32; successively, the second sheet P2 slides on the surface of the first sheet P1 as lightly pressed by the first conveyance roller means 31, and is conveyed and stopped.

The sheets on and after the third one is conveyed one by one, in the condition that the solenoid SD4 is switched over to the off-state of the electric current and returns to the state shown in FIG. 8, to make the follower roller 31B be strongly pressed by the two plate springs 43 and 44.

(The Second Embodiment)

Figure 12:
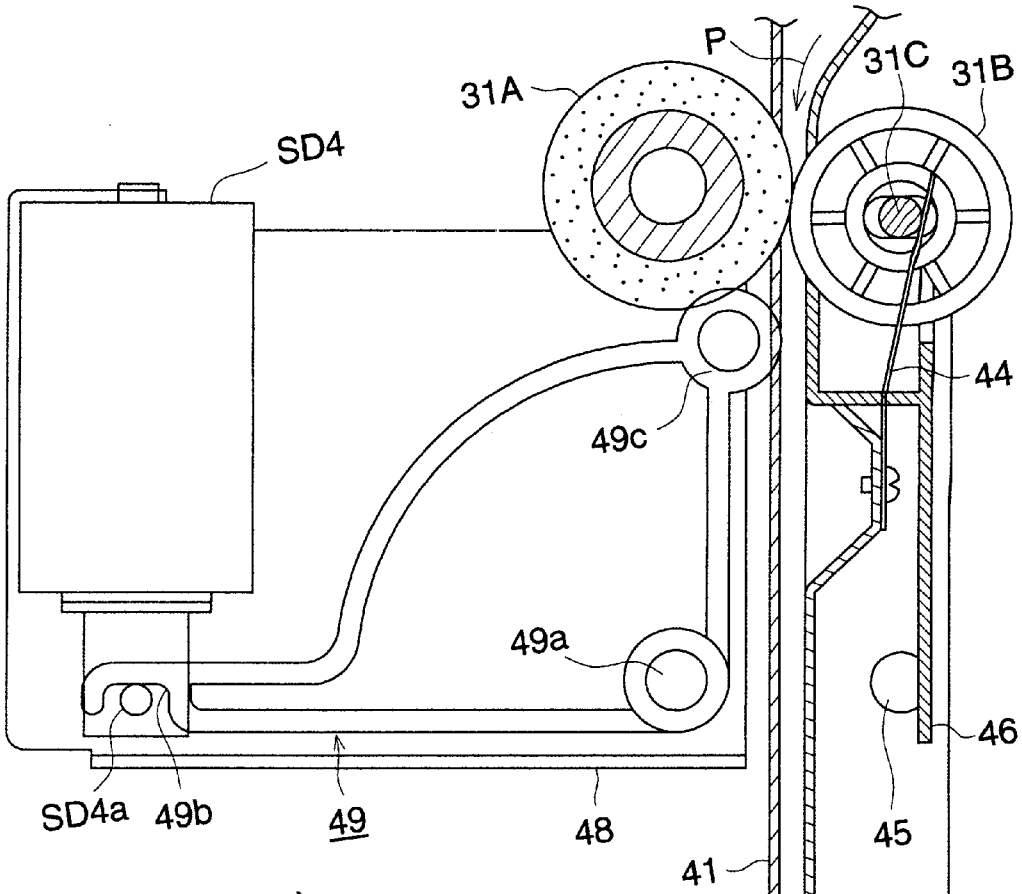
FIG. 12(*a*) is a cross-sectional view of the portion in the neighborhood of the conveyance rollers showing the second embodiment of this invention, and FIG. 12(*b*) is the plan of a part of it.
Figure 12:
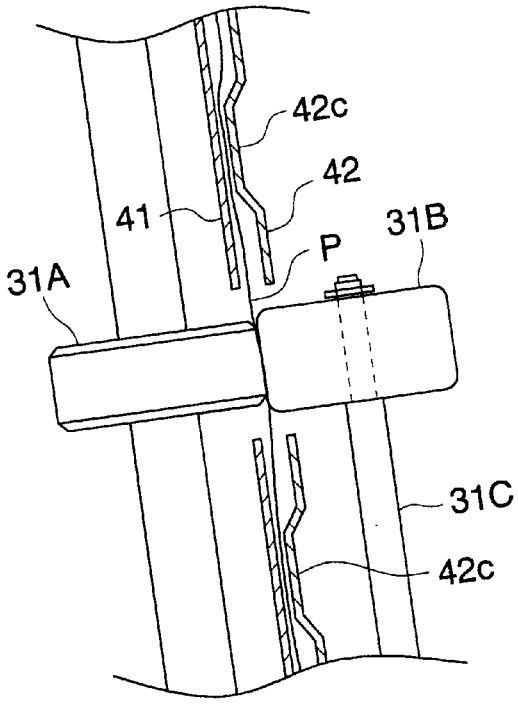
Figure 13:
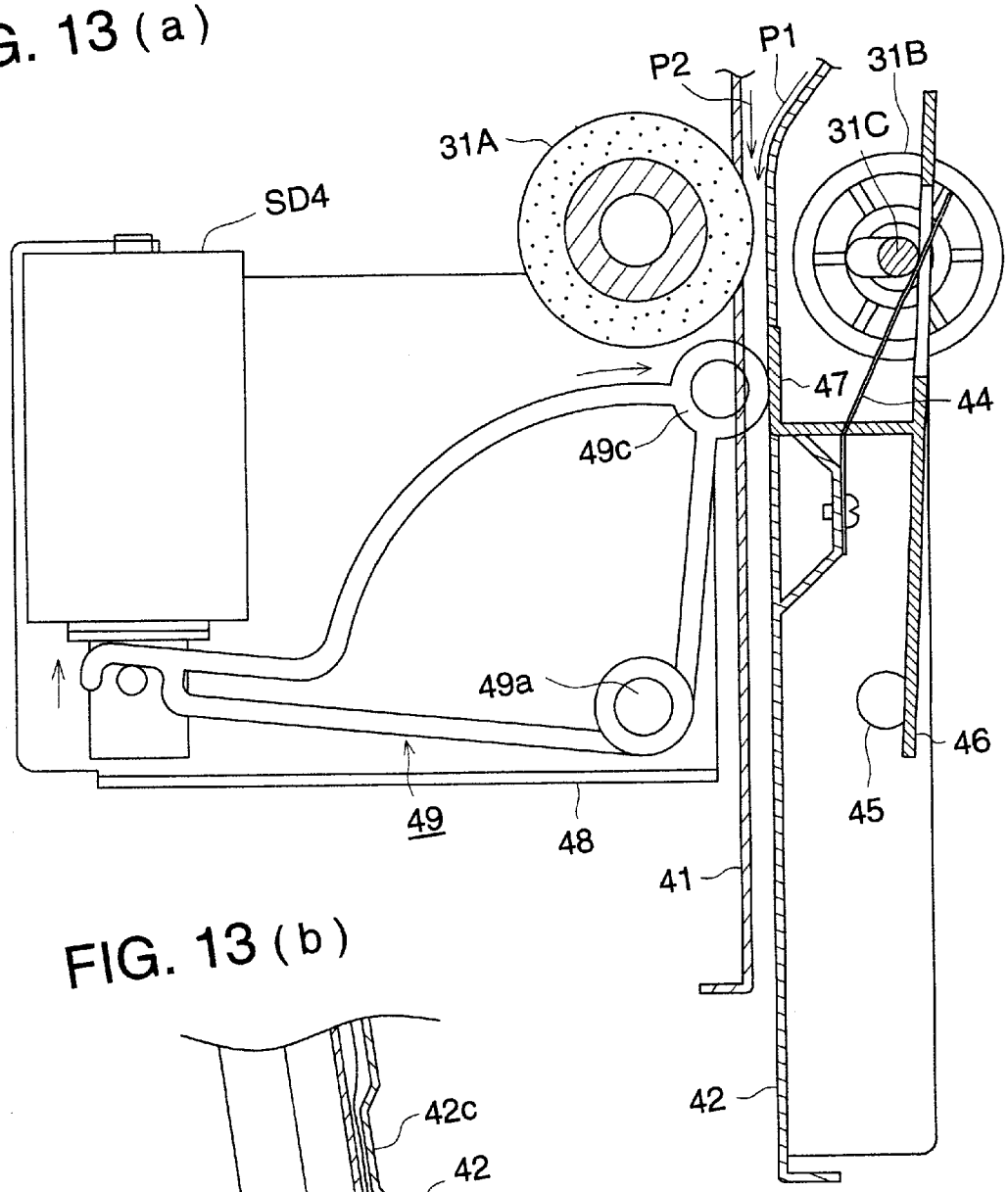
FIG. 13(*a*) is a cross-sectional view showing the gripping pressure change means at the time of conveying two overlapped usual sheets by the conveyance rollers of the second embodiment of this invention, and FIG. 13(*b*) is the plan of a part of it.
Figure 13:
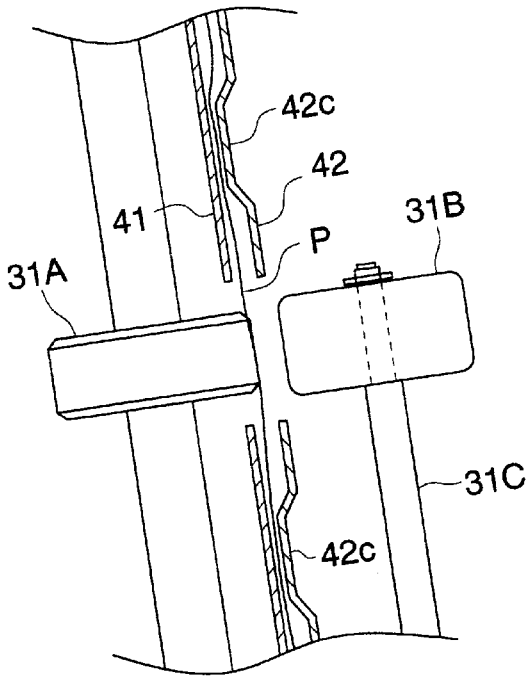

FIG. 12 and FIG. 13 show the second embodiment of this invention. FIG. 12(*a*) is a cross-sectional view in the neighborhood of the first conveyance roller means 31, and FIG. 12(*b*) is the plan of a part of it, showing the situation where a thick sheet is conveyed. Besides, with respect to the signs used in these drawings, the same ones are given to the portions having the same function as those in the above-described first embodiment. Further, only the points which are different from those in the first embodiment will be explained.

The free end portion of the plate spring 44, of which one end is fixed to the movable guide plate 42, presses the shaft 31C of the follower roller 31B. By this pressing force of the plate spring 44, the follower roller 31B is strongly pressed to the driving roller 31A, to grip a sheet between them.

In the movable guide plate 42 facing the fixed guide plate 41, a plurality of protrusions 42*c* are formed in the neighborhood of the follower roller 31B. The plane of the protrusions 42*c* facing the fixed guide plate 41 is located at the side of the driving roller 31A with respect to a plane extended from the nip portion where the driving roller 31A and the follower roller 31B press each other, and forms a narrow path together with the fixed guide plate 41.

The sheet P conveyed by the first conveyance roller means 31 progresses straight with a wave-shaped deformation parallel to the sheet conveyance direction formed by the first conveyance roller means 31 and the protrusions 42*c*.

FIG. 13(*a*) is a cross-sectional view in the neighborhood of the first conveyance roller means 31, and FIG. 13(*b*) is the plan of a part of it, showing the situation where two usual sheets overlapped are conveyed.

When it is set the mode in which the first sheet (usual sheet) P1 and the second sheet (usual sheet) P2 are conveyed in the condition of two sheets being overlapped, the solenoid SD4 is actuated to attract the plunger pin SD4*a*, which presses the engaging portion 49*b* at one end of the oscillation driving member 49, to oscillate the oscillation driving member 49 around the shaft 49*a* in the clockwise direction as shown in the drawing.

The pressing portion 49*c* presses the oscillation receiving member 47 through the oscillation of the oscillation driving means 49, to oscillate the oscillating shaft 45 and the oscillating member 46 in the clockwise direction as shown in the drawing. The shaft 31C of the follower roller 31B is supported by the oscillating member 46.

By the oscillation of the oscillating member 46, the follower roller 31B is detached and retracted from the nip position of the follower roller 31B and the driving roller 31A.

In this state, the first sheet (usual sheet) P1 progresses straight with wave-shaped deformation formed parallel to the conveying direction by the rotating driving roller 31A, the fixed guide plate 41, and the movable guide plate 42 having protrusions 42*c*.

Successively, the second sheet P2 slides on the surface of the first sheet P1, and progresses straight with wave-shaped deformation formed by the driving roller 31A, the fixed guide plate 41, and the movable guide plate 42. The sheets on and after the third one is conveyed one by one, in the condition that the solenoid SD4 is switched over to the off-state of the electric current and returns to the state shown in FIG. 12, to make the follower roller 31B be strongly pressed by the single plate spring 44.

Figure 14:
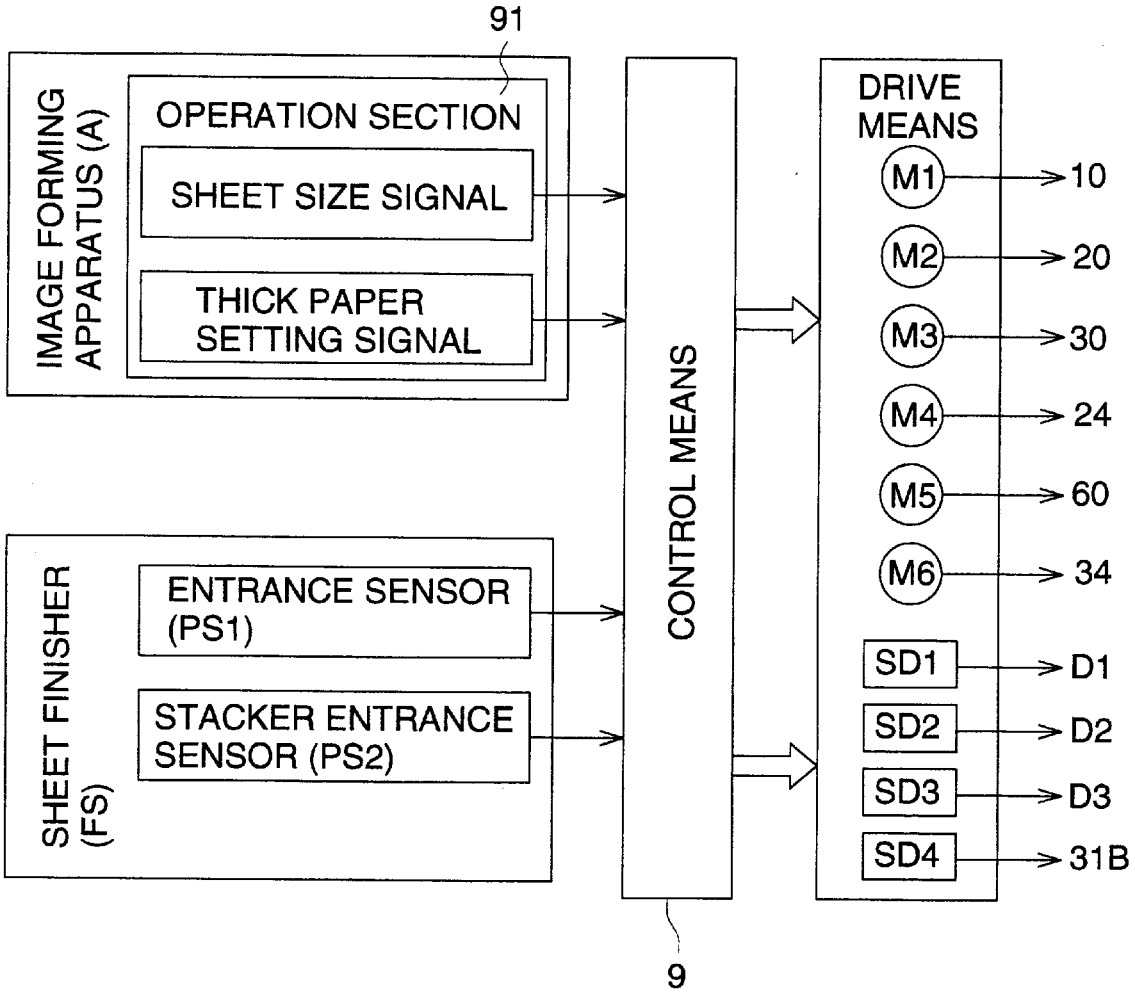
FIG. 14 is a block diagram showing the drive control based on this invention.

FIG. 14 is a block diagram for controlling the driving in the embodiments 1 and 2.

Before the stapling processing by the sheet finisher FS, the sheet size signal and the thick sheet setting signal are transmitted from the operation section 91 of the image forming apparatus mainframe A to the control means 9 of the sheet finisher FS. A sheet having an image already formed on it is brought in the sheet finisher FS, the passing of the sheet P through the path a is detected by the entrance sensor PS1, the passing of the sheet P through the path h is detected by the intermediate stacker entrance sensor PS2, and these detection signals are inputted in the control means 9.

The control means 9 processes the above-mentioned inputted signals, to actuate the motor driving means (M1 to M6) and the solenoid driving means (SD1 to SD4).

Figure 15:
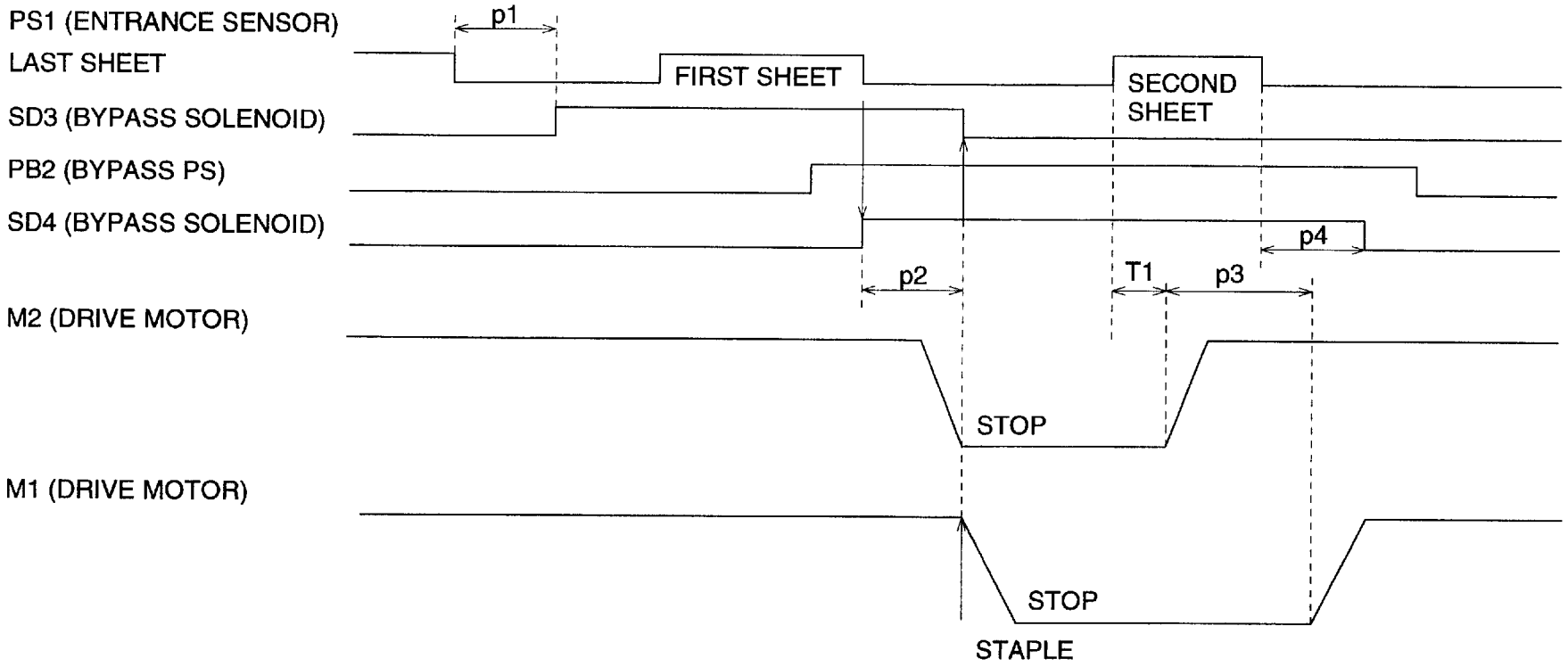
FIG. 15 is a timing chart showing the drive control based on this invention.

FIG. 15 is a timing chart for controlling the driving in the embodiments 1 and 2. In the following, the finish-processing procedure based on the conveying of overlapped two sheets will be shown. The finish-processing procedure will be shown below.

(1) When p1 pulses have been counted after the passing of the trailing edge of the last sheet of a preceding bunch of sheets was detected by the entrance sensor PS1, the solenoid SD1 is actuated to open the path g1, to make it possible for the first sheet P1 to pass through it.

(2) With respect to the sheet P1, which has been discharged from the image forming apparatus mainframe, by the start of the driving by the drive motor M1, M2, and M3, when the passing of the trailing edge of the first sheet P1 is detected by the entrance sensor PS1, the solenoid SD1 is actuated, to reduce the pressing force of the follower roller 31B through the oscillation driving member 49 and the oscillating member 46, and the conveyance of overlapped two sheets is made possible (refer to FIG. 11 and FIG. 13).

(3) When p2 pulses have been counted after the passing of the trailing edge of the first sheet P1 was detected by the entrance sensor PS1, the solenoid SD3 is made off, to intercept the path g1, to open the path g2, and to make it possible for the second sheet P2 pass through it (refer to FIG. 5).

(4) After p2 pulses are counted, the rotations of the drive motor M1 and the drive motor M2 are successively stopped. During this time of stop, the stapling processing for the preceding bunch of sheets is carried out.

(5) When the time T1 by a timer has passed after the passing of the trailing edge of the sheet P2 was detected by the entrance sensor PS1, the drive motor M2 starts driving to rotate the first conveyance roller means 31, to convey the sheets P1 and P2 in the condition of two sheets being overlapped.

(6) After the above-described time T1 and the succeeding counting of p3 pulses, the drive motor M1 starts driving, to carry out the conveyance of the succeeding sheets.

(7) When p4 pulses have been counted after the trailing edge of the second sheet P2 was detected by the entrance sensor PS1, the solenoid SD4 is made off, to make strong the pressing force of the follower roller 31B, to make it possible to convey a thick sheet (refer to FIG. 8 and FIG. 12).

In order to convey a thick sheet by the first conveyance roller means 31, a large conveyance force is required, and further, in order to convey this thick sheet in the condition of two sheets being overlapped, a larger conveyance force is required.

For this reason, by such a weak conveyance force as not to produce problems such as the damage of the leading edge portion of a sheet produced when it is stopped by the second conveyance roller means 32 for stopping sheets at the downstream side, poor conveyance, and the smudging of the rollers, it is not possible to convey overlapped two sheets of thick sheet.

When the thick sheet setting is made, it is desirable that the thick sheet conveyance in the image forming apparatus mainframe A is carried out at a speed slower than that for usual sheets in order to form a satisfactory image on a thick sheet; the conveyance of the thick sheet in the condition of overlapped two sheets is prohibited, and the two sheets P1 and P2 are successively conveyed while the preceding bunch of sheets is processed to be stapled. Therefore, in the case where the thick sheet signal is outputted from the image forming apparatus mainframe A, the conveyance of overlapped two sheets is not carried out, and a single sheet of thick sheet is conveyed with a weak conveyance force, hence, the conveyance of overlapped two sheets is carried out only in the case of usual sheets.

With respect to the recognizing means for recognizing the thickness of the sheet, the thick sheet setting is selected and set by the thick sheet setting means provided in the operation panel of the image forming apparatus mainframe A. In other way, it may be based on a recognizing means detecting the thickness of a sheet or a strength against bending.

(The Third Embodiment)

Figure 16:
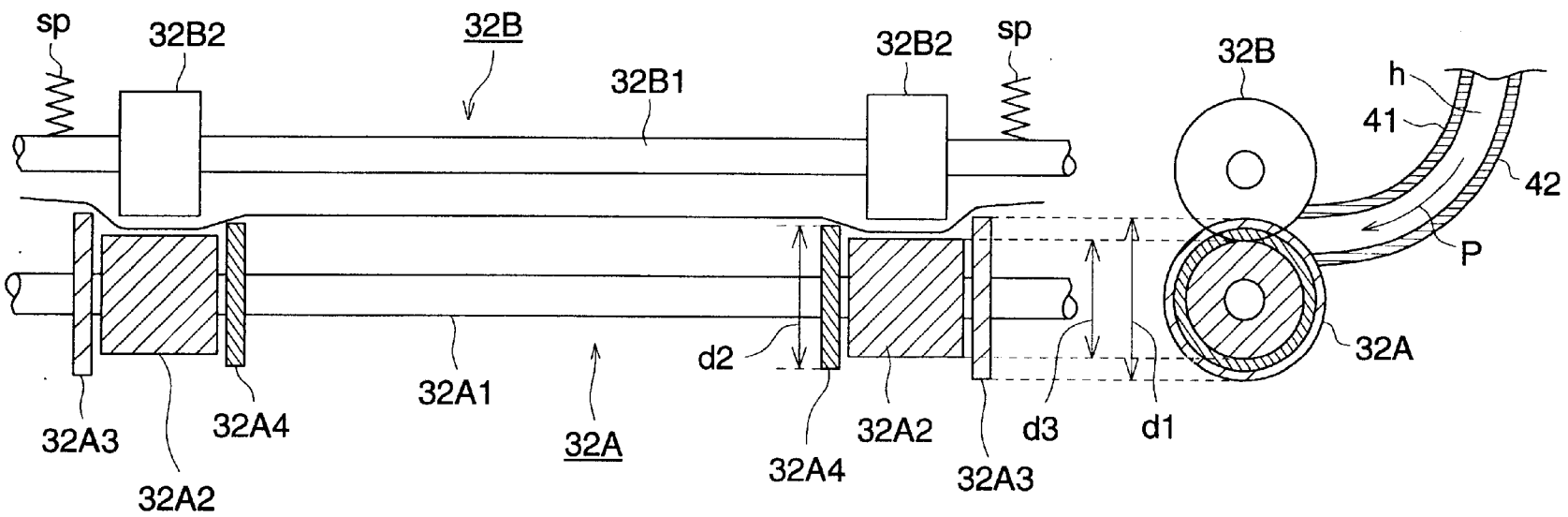
FIG. 16(*a*) and FIG. 16(*b*) are the front view and the side cross-sectional view of the conveyance rollers for stopping the sheets of the third embodiment of this invention, respectively.
Figure 17:
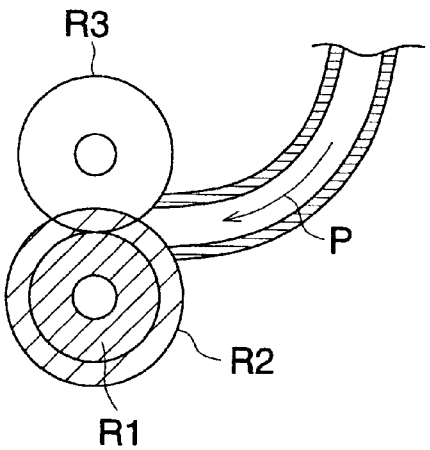
FIG. 17(*a*) and FIG. 17(*b*) are the front view and the side cross-sectional view of the sheet ejecting portion of a conventional sheet finisher, respectively.
Figure 17:
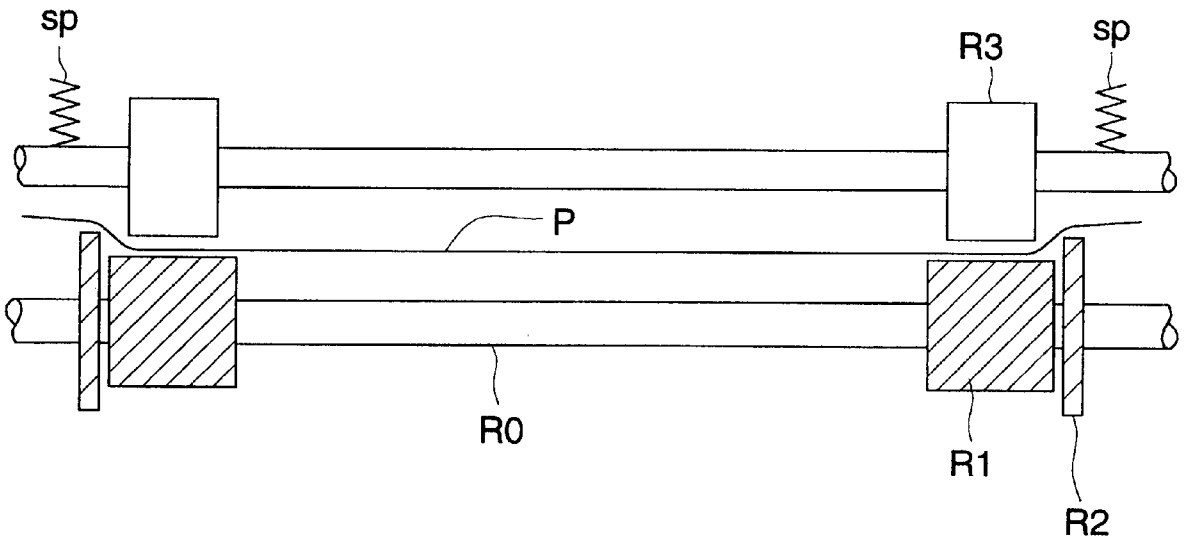

FIG. 16(*a*) and FIG. 16(*b*) are the front view and the side cross-sectional view of the conveyance rollers for stopping the sheet of the third embodiment of this invention, respectively.

The sheet P which is gripped and conveyed by the first conveyance roller means 31 passes through the path g1 formed between the fixed guide plate 41 and the movable guide plate 42, and is batted against the second conveyance roller means 32 in the still-standing state, to be stopped temporarily.

The drive conveyance roller 32A of the second conveyance roller means 32 is composed of the rotary shaft 32A1 connected to the drive source, the driving roller members 32A2 fixed to the rotary shaft 32A1, hard flange members 32A3 respectively fixed to the rotary shaft 32A1 close to one (outer) side of the driving roller members 32A2 in the direction of the rotary shaft, and the elastic flange members 32A4 fixed respectively to the rotary shaft 32A1 close to the other (inner) side of the driving roller members 32A2 in the direction of the rotary shaft.

The driving roller members 32A2 and the flange roller members 32A4 are formed of a rubber material having elasticity such as an ethylene-propylene rubber (EPDM). The hard flange members 32A3 are formed of a hard resin material such as a poly-acetal (POM).

Let d1 be the outer diameter of the hard flange members 32A3, d2 be the outer diameter of the elastic flange members 32A4, and d3 be the outer diameter of the driving roller members 32A2, then the following relation d1>d2>d3 has been set.

The follower roller members 32B2 fixed to the shaft 32B1 of the follower conveyance roller 32B are urged by springs to be pressed to the driving roller members 32A2.

By providing a set of flange members for forming the wave-shaped deformation composed of the elastic flange member 32A4 (outer diameter d2) and the hard flange member 32A3 (outer diameter d1), both having a larger outer diameter than that of the driving roller member 32A2 (d3) at the left and right side of each of the driving roller members 32A2 in the direction of the shaft, the leading edge portion of the sheet P, which passes the path h and is conveyed to the second conveyance roller means 32, strikes against the outer circumferential surface of the hard flange members 32A3 having a larger outer diameter than that of the elastic flange members 32A4 (d2), is moved smoothly along the outer circumferential surface of the rotating hard flange members 32A3, and is guided to the nip position of the second conveyance roller means 32. Owing to this, the occurrence of a hollow is suppressed, to prevent damage.

After the leading edge portion of the sheet P has passed the nip position of the second conveyance roller means 32, the sheet P is conveyed with a wave-shaped deformation being formed by the sheet gripping force of the elastic flange members 32A4 having a large coefficient of friction.

Owing to the elastic flange members 32A4 having the outer diameter d2, which satisfies the relation set as d1>d2>d3, without applying such a strong pressing force as to give an damage to sheets, various kinds of sheets from a thin sheet to a thick sheet, and for various kinds of sheets from a sheet having a material quality of low stiffness to a sheet having a material quality of high stiffness, a stable sheet conveyance has become possible.

Further, in the embodiments of this invention, a sheet finisher which is connected to a copying machine has been shown, however, the invention can be applied to a sheet finisher to be used by being connected to an image forming apparatus such as a printer and a facsimile apparatus, light duty pressing machine, etc.

(The Fourth Embodiment)

In the sheet conveyance apparatus of this invention, the above-described first conveyance roller means 31 is provided, said conveyance roller means 31 is provided with conveyance rollers composed of driving roller 31A and the follower roller 31B and the above-described gripping pressure change means for changing the gripping pressure of said conveyance rollers, and said gripping pressure change means is composed of the plate springs 43 and 44, the oscillating member 46, the oscillation driving member 49, the oscillation receiving member 47, and the solenoid SD4, and makes it possible to change the gripping-pressing force of said conveyance rollers in accordance with the thickness of a sheet recognized by a recognizing means for recognizing the thickness of the sheet. In addition, the change of the gripping pressure is carried out in such a manner as has been described in the above-described embodiments 1 to 3.

Figure 18:
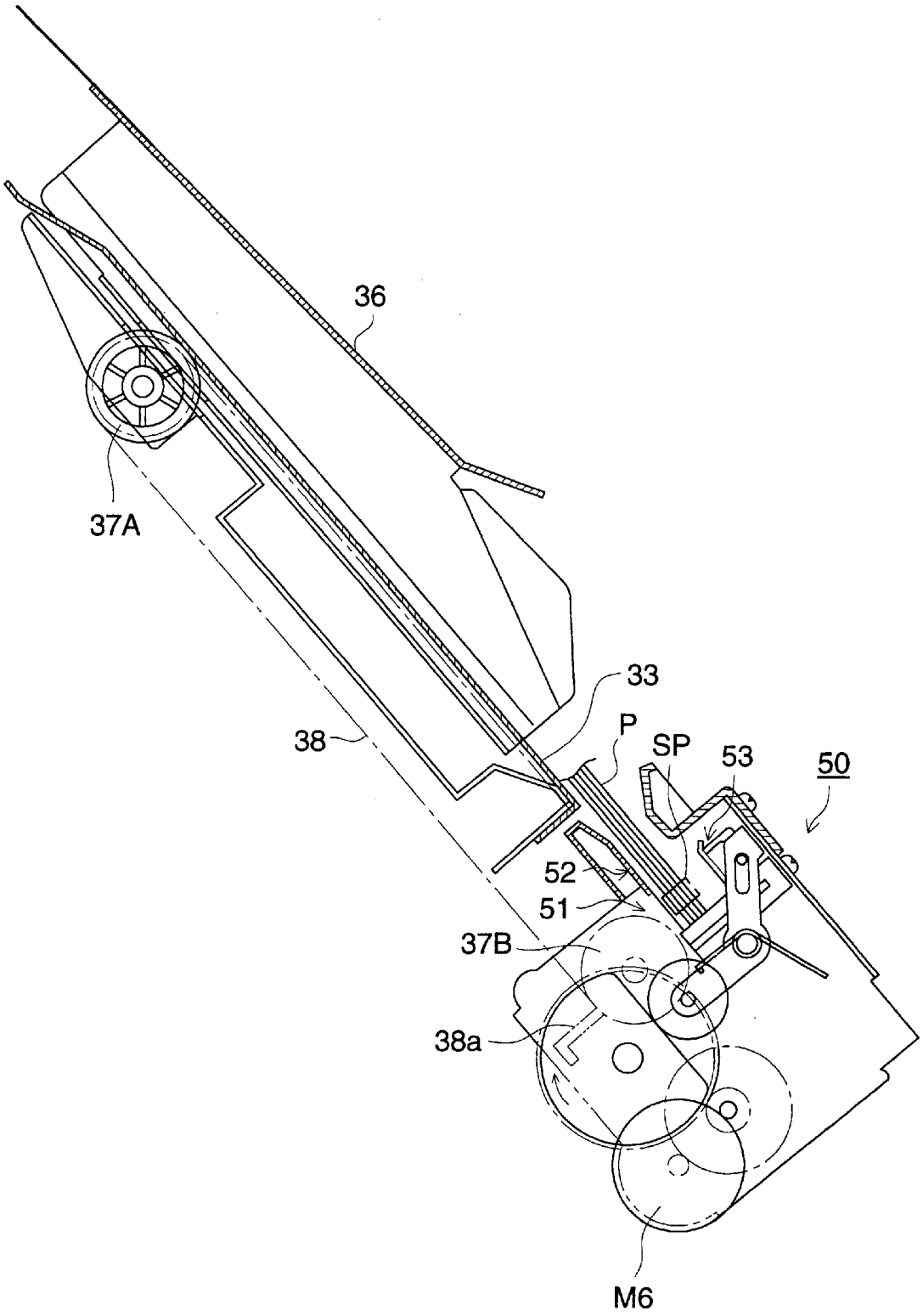
FIG. 18 is a cross-sectional view of the stapler and the sheet stacking means.

FIG. 18 is a cross-sectional view of the binding means 50 (hereinafter referred to as the stapler 50) and the sheets stacking means.

The stapler 50 is composed of the lower staple-processing portion 51 having a staple hole portion for projecting a binding pin (a staple) SP, the lower guide member 52 for guiding a conveyed sheet while holding its lower surface, the upper staple-processing portion 53 capable of moving up and down for pressing and staple-processing a bunch of sheets stacked in the lower staple-processing portion 51, the drive means for driving the upper staple-processing portion up and down, the staple supplying means not shown in the drawing, and the drive motor M6.

The lower staple-processing portion 51 is a staple driving portion, which is fixed to the housing of the stapler 50, and holds and drives the staple SP fed from the staple supplying means. The upper staple-processing portion 53 is a staple receiving portion at the clinch side, which is moved up and down by the drive means, and stops a staple in engagement by pressing the end portion of the staple to bend.

The bunch of sheets, which has a staple driven from the bottom to the top at the trailing edge portion by the stapler 50, is conveyed by the ejection fingers 38*a* of the ejection belts 38 which has started revolving, glides obliquely upward on the intermediate stacker 33, and is fed in the ejecting rollers 24 (refer to FIG. 3).

Figure 19:
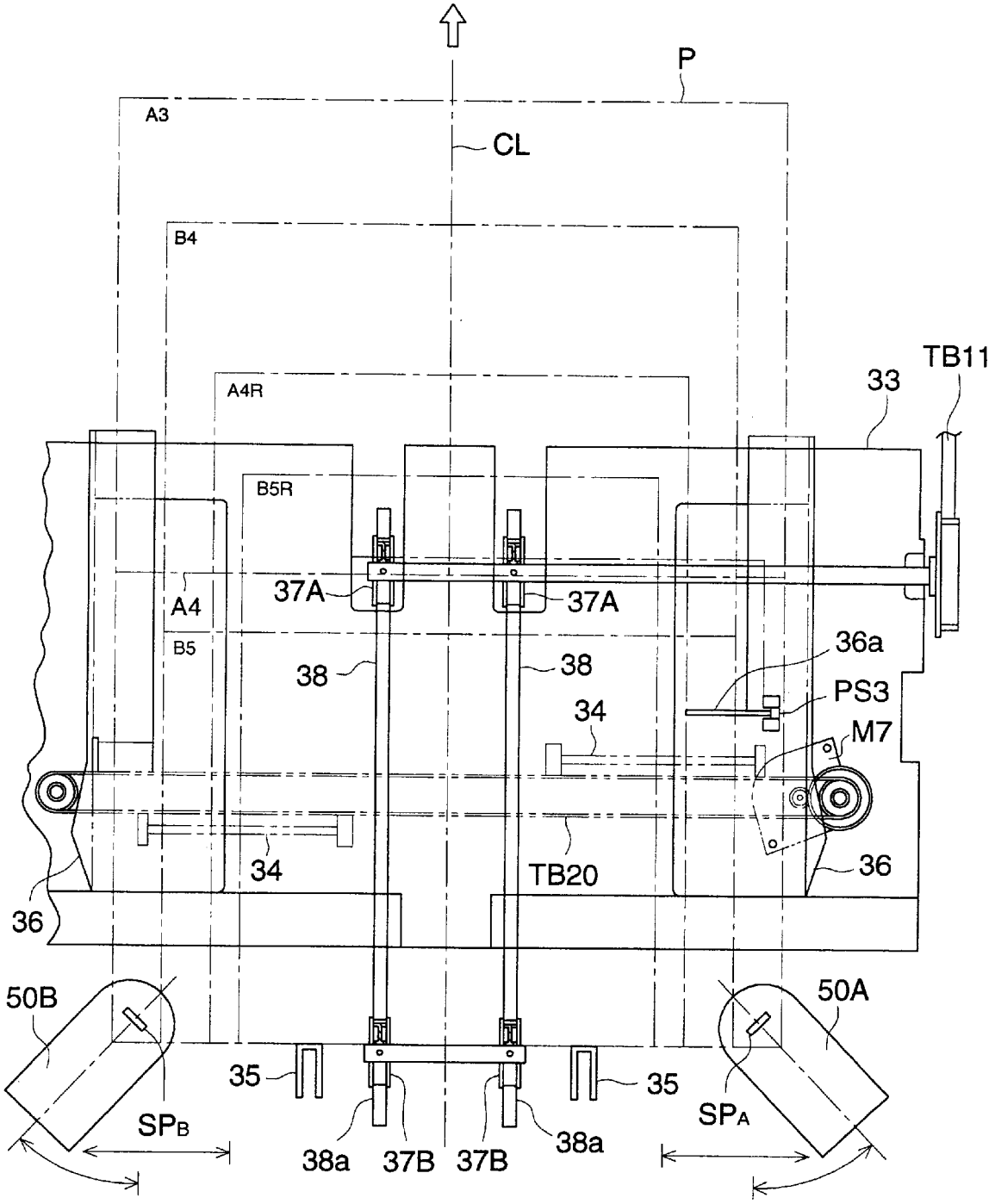
FIG. 19 is the plan of the sheet stacking means including the intermediate stacker, width aligning members, and two staplers.

FIG. 19 is the plan of the sheet stacking means including the intermediate stacker 33, the width aligning members 36, the two staplers 50A and 50B.

In the drawing, the two width aligning members 36 are disposed symmetrically in the left-to-right direction with respect to the central line CL, and are capable of moving simultaneously in the direction perpendicular to the conveying direction of the sheet P. Each of the left and right width aligning members is fixed to the timing belt TB20 and moves in sliding contact with the guide bar 34.

The width aligning members 36 as shown in FIG. 19 are in the state of being located at the home positions. This home position is detected and controlled by the projecting portions (portions to be detected) provided in the width aligning members 36 and the home position detecting sensor (the HP sensor) PS3 provided in the intermediate stacker 33. Besides, the single dot and dash lines shown in FIG. 19 indicate the sheets of various sizes.

The staplers 50A and 50B are disposed symmetrically in the left-to-right direction with respect to the above-mentioned central line CL, are capable of moving in the sheet width direction in accordance with the sheet size, and are supported in such a manner as to be capable of oscillating so as to make it possible to select the driving angle of the staples $SP_A$ and $SP_B$.

FIGS. 20(*a*),(*b*),(*c*) and (*d*) are a schematic drawings showing the aligning operation of the width aligning members 36A and 36B, and FIG. 21 is a timing chart showing the movement of the width aligning members 36.

The productivity of copying is improved by it that the sheets of various sizes to be subjected to finish-processing by the sheet finisher FS are classified and recognized into the three groups, that is, large-sized sheets (A3, B4, 11"×17", 8.5"×14", etc.), small-sized sheets (A4, B5, 8.5"× 11", etc.), and R-sized sheets (A4R, B5R, 8.5"×11"R, etc.), and the start timing of the aligning operation is controlled in a manner such that the driving of the group of the above-mentioned large-sized sheets is done at an early timing and the driving of the group of the small-sized sheets is done at a late timing, in the first aligning condition.

(1): When the sheet size signal and the sheet finish-processing designating signal are inputted from the image forming apparatus mainframe A to the control means 9 of the sheet finisher FS, the width aligning members 36 moves from the home positions HP (refer to FIG. 20(*a*), the inner dimension of the width aligning members: W0) to the first positions K1 (refer to FIG. 20(*b*), the inner dimension of the width aligning members: W1), by the start of driving of the drive motor M7. Said first positions K1 are set to the standby positions which are 10 mm away from the sheet width W to the both sides respectively, taking into consideration the dispersion of the positions in the width direction by conveying of the sheets conveyed out from the image forming apparatus mainframe A (for example, about ±5 mm in the width direction), in order that the width aligning members should not get in contact with the sheets being conveyed in.

(2): When the predetermined time t0 (for example, 150 ms) has passed after the trailing edge portion of the sheet which has been brought in the sheet finisher FS passed sensor PS2 at the entrance of the intermediate stacker to make it switch on, the width aligning members move to the positions K2 by the driving of the drive motor M7 (refer to FIG. 20(*c*), the inner dimension of the width aligning members 36: W2). The timing of movement to this second positions K2 is the timing when the sheet P, which has been conveyed out from the conveyance rollers 32 onto the intermediate stacker 33, starts to slide down on the surface of the intermediate stacker 33 which is disposed in a tilted position (refer to FIG. 20(*c*)).

(3): The control means 9 judges it by comparison on the basis of the sheet size signal inputted from the image forming apparatus mainframe A whether the sheet P is one of the large-sized sheet group, of the small-sized sheet group, or of the R-sized sheet group set beforehand, and if it is a sheet of the large-sized sheet group, the predetermined time t1 (for example, 230 ms) is set by the timer, or if it is a sheet of the small-sized or R-sized sheet group, the predetermined time t2 (for example, 140 ms) is set by the timer. This is done for the purpose of improving the productivity of the small-sized sheets, by setting the alignment starting time of the small-sized sheets early while setting that of the large-sized sheets late, because the sheet down-sliding time from the entry in the intermediate stacker 33 to the arrival at the stopper 35 varies depending on the sheet size, that is, the larger the sheet size is, the longer the down-sliding time becomes, and the smaller the sheet size is, the shorter the down-sliding time becomes.

(4): After the above-described predetermined time t0 has passed, the timer for the predetermined time t1 or t2 is made to start. When the timer for the predetermined time t1 or t2 has counted up the predetermined time, through controlling the drive means in the above-described first condition by the control means 9, the drive motor M7 for aligning the width starts rotating for driving, to move the width aligning members 36, to make them reach the third positions K3, to which the sheet P is aligned.

These third positions K3 in the above-described first aligning condition are set to the positions which are located a little narrower than the sheet width W, that is, to the positions such that the sheet width W is subtracted by ΔW=3 mm for the both sides, which is equivalent to ΔW/2=1.5 mm for the single side. At the third positions K3, the trailing edge of the sheet having slid down on the intermediate stacker 33 is batted against the stopping surface of the stoppers 35 provided in the vicinity of the staplers 50, while the both side edges of the sheet P are tapped and pressed by the width aligning members 36, to be subjected to the width alignment (refer to FIG. 20(*c*)).

The stacked plural sheets P are bent and pressed to such a degree as to make a clearance between sheets by the width aligning members.

(5): When the alignment pulses to the drive motor M7 have been count up, the drive motor M7 is reversed, to drive to move the width aligning members, and returns them to the above-described first positions K1.

At the time of overlapped sheet conveyance in which the conveyance rollers 31 and 32 grip the first sheet P1 and the second sheet P2 to convey them to the intermediate stacker 33 in which they are received, the control means 9 controls the initial aligning process in which sheets P are received in the intermediate stacker 33 and aligned on the basis of the second aligning condition.

For example, the number of aligning times of the sheets P in the second aligning condition by the width aligning members 36 is set to an increased value larger than that in the first aligning condition. In other way, by making narrow the compressing width W3 of the width aligning members 36 shown in FIG. 20(*d*), the pressing force in the second aligning condition is made larger than that in the first aligning condition.

Further, the control means carries out the control by the first aligning condition for the initial predetermined number of sheets stacked on the intermediate stacker 33, or the third aligning condition for a number of sheets exceeding the predetermined number, both being provided. For example, the number of aligning times by the width aligning members or the moving distance of them is set variable.

Further, by making the aligning condition the second one in the case where the sheets which are to be aligned by the width aligning members 36 are thick sheets, and making it the first aligning condition in the cases of usual sheets other than that, the alignment is made variable.

The conveyance means comprises a overlapped sheet conveyance means for gripping and conveying the first sheet and the second sheet overlapped to the intermediate stacker in which they are received, and the control means makes a control so as to vary the aligning condition at the time of the overlapped sheet conveyance.

In the following, the variable control of the number of aligning times by the width aligning members 36 will be explained with reference to FIG. 21. Besides, concerning the movement of the width aligning members 36, the movement toward the center in the sheet width direction is called progressing, and the movement to the outer side is called retreating.

(1) TEH CASE WHERE FIVE OR LESS SMALL-SIZED SHEETS ARE STAPLE-PROCESSED

In the column of "usual alignment", "small-sized", "five sheets or less" shown in the drawing, the width aligning members 36 progress by 10 steps from the initial positions to the inner side in the width direction to be stopped at the standby positions, by the driving of the drive motor M7 made up of a stepping motor.

After the predetermined time t2 has passed at this standby positions, the width aligning members 36 further progress by 26 steps to the inner side in the width direction, then, they retreat by 36 steps to return to the initial positions.

In this progressing process, the width aligning members 36 press the side edges of the overlapped two sheets P, which have slid down on the intermediate stacker 33 and are in contact with the stopper 35, to make width alignment. They make the same width alignment as the above-described for the succeeding sheets too.

In the column of "last sheet alignment", "small-sized", "five sheets or less" shown in the drawing, in the case where the width alignment is carried out by pressing the side edges in the width direction of the overlapped two sheets P, which are the small-sized sheets P to make the last ones making up a bunch of sheets, having slid down on the upper surface of the preceding sheet stacked on the intermediate stacker 33 and being in contact with the stopper 35, after the predetermined time t2 has passed at the standby positions, the width aligning members 36 progress by 26 steps toward the inner side in the width direction to make width alignment by pressing the side edges of the sheets P, then retreat by 10 steps, and again progress by 10 steps to make width alignment again. Further, the width aligning members 36 retreat 12 steps, and again progress 5 steps to stand still in the state of being in contact with the side edges of the sheets P in the width direction. In this state of standing still, the staple-processing is carried out.

(2) THE CASE WHERE SIX OR MORE SMALL-SIZED SHEETS ARE STAPLE-PROCESSED

In the column of "usual alignment", "small-sized", and "six sheets or more" shown in the drawing, the width aligning members 36 progress by, 10 steps from the initial positions to the inner side in the width direction, and stand still at the standby positions. After the predetermined time t2 has passed at these standby positions, the width aligning members 36 further progress to the inner side by 15 steps to make width alignment, then, they retreat by 25 steps to return to the initial positions. By shortening the progressing distance of the width aligning members 36, it is prevented that the stepping motor goes out of tuning by the resistance of the sheets when pressing the side edges of a number of sheets.

In the column of "last sheet alignment ", "small-sized", and "6 to 13 sheets" shown in the drawing, after the predetermined time t2 has passed at the standby positions, the width aligning members 36 retreat by 16 steps, and then progress by 30 steps to make width alignment. Further, they retreat by seven steps, and again progress by 11 steps to stand still in the state of being in contact with the side edges of the sheets P in the width direction. In this still-standing state, the staple-processing is carried out.

(3) THE CASE WHERE LARGE-SIZED SHEETS ARE STAPLE-PROCESSED

In the column of "usual alignment" and "large-sized" shown in the drawing, the width aligning members 36 progress by 10 steps from the initial positions to the inner side in the width direction, to stand still at the standby positions. After the predetermined time t1 (for example, 230 ms) has passed at these standby positions, they progress by 21 steps to make width alignment, then, retreat by 31 steps, to return to the initial positions.

In the column of "last sheet alignment, large-sized, and "9 sheets or less" shown in the drawing, the width aligning members 36 progress by 10 steps from the initial positions to the inner side in the width direction, to stand still at the standby positions. After the predetermined time t1 (for example, 230 ms) has passed, the width aligning members 36 progress by 17 steps to make width alignment, then, retreat by 30 steps, and again progress by 30 steps to make width alignment for the second time; further, they retreat by 31 steps and progress by 33 steps, to make width alignment for the third time, then return to the initial positions.

(4) THE CASE WHERE SMALL-SIZED SHEETS ARE STAPLE-PROCESSED

In the column of "thick sheet alignment (usual)", "small-sized" shown in the drawing, the width aligning members 36 progress by 10 steps from the initial positions to the inner side in the width direction, to stand still at the standby positions. After the predetermined time t2 (for example, 140 ms) has passed, the width aligning members 36 progress by 21 steps to make width alignment, then retreat by 31 steps, to return to the initial positions.

In the column of "thick sheet (last sheet)", "small-sized", "13 sheets or less" shown in the drawing, the width aligning members 36 progress by 10 steps from the initial positions to the inner side in the width direction, to stand still at the standby positions. After the predetermined time t4 (for example, 240 ms) has passed, the width aligning members 36 retreat by 14 steps, and progress by 30 steps to make width alignment; then, they retreat by 7 steps, and progress by 9 steps to make width alignment for the second time, and return to the initial positions.

(5) THE CASE WHERE LARGE-SIZED THICK SHEETS ARE STAPLE-PROCESSED

In the column of "thick sheet (usual)" and "large-sized" shown in the drawing, the width aligning members 36 progress by 10 steps from the initial positions to the inner side in the width direction, to stand still at the standby positions. After the predetermined time t1 (for example, 230 ms) has passed, as in the case of the above described smallsized thick sheet, the width aligning members 36 progress by 21 steps to make width alignment, then retreat by 31 steps, to return to the initial positions.

In the column of "thick sheet (last sheet)", "large-sized", "9 sheets or less" shown in the drawing, the width aligning members 36 progress by 10 steps from the initial positions to the inner side in the width direction, to stand still at the standby positions. After the predetermined time t3 (for example, 230 ms) has passed, the width aligning members 36 progress by 17 steps to make width alignment; then, they retreat by 30 steps, and progress by 30 steps to make width alignment for the second time, then, retreat by 31 steps and progress by 33 steps to make width alignment for the third time, and return to the initial positions.

In addition, in the above-described embodiments, the sheet size are classified into three classes of large, small, and R; however, this invention should not be confined to this, and the sheet size may be classified into the three classes of large, medium, and small, or into more number of classes, or it may be classified even into the respective sheet sizes.

Figure 22:
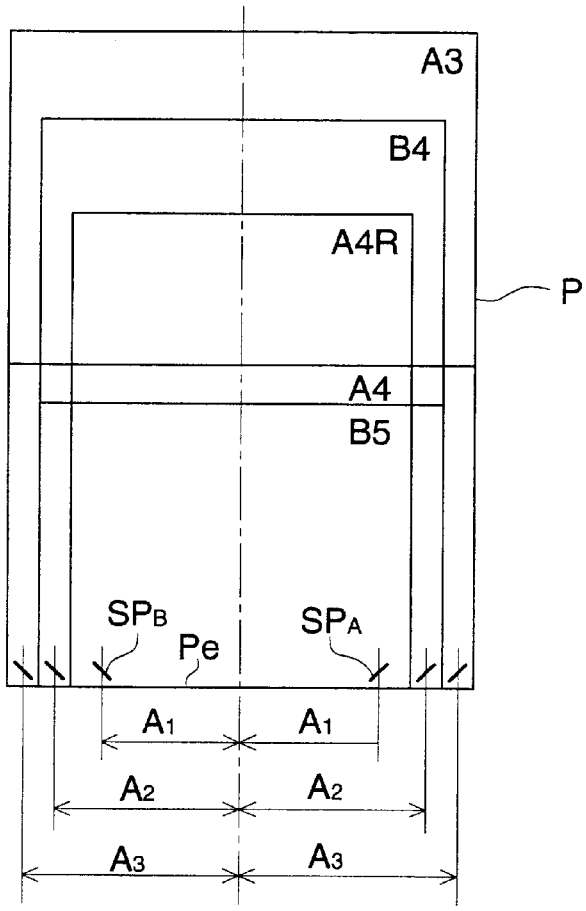
FIG. 22(*a*) and FIG. 22(*b*) are the plan showing the positions of the staples which are driven into the sheets of various sizes.
Figure 22:
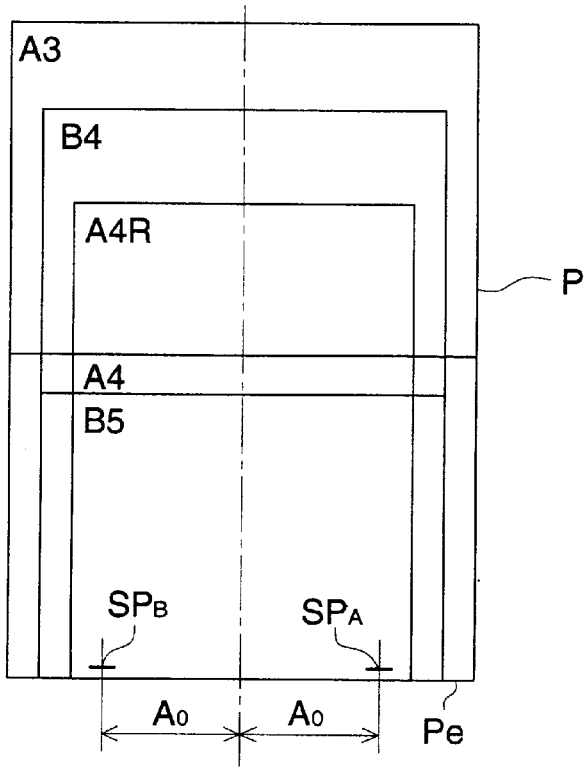

FIG. 22(*a*) is the plan showing the position of the staple SP driven at the corner of the leading edge portion Pe of each of the sheets of various sizes. The staplers 50A and 50B are oscillated to the position of 45° inclination, move straight in the direction parallel to the leading edge Pe of the sheets P, and drive the staple $SP_A$ (or $SP_B$) in the sheet at one stapling position near the corner located at the predetermined distance of $A_1$, $A_2$, or $A_3$.

FIG. 22(*b*) is the plan showing the positions of the staples $SP_A$ and $SP_B$ which are driven in the sheet at the two points of the predetermined distance $A_0$ in the direction parallel to the leading edge Pe of the sheets P of various sizes.

Figure 23:
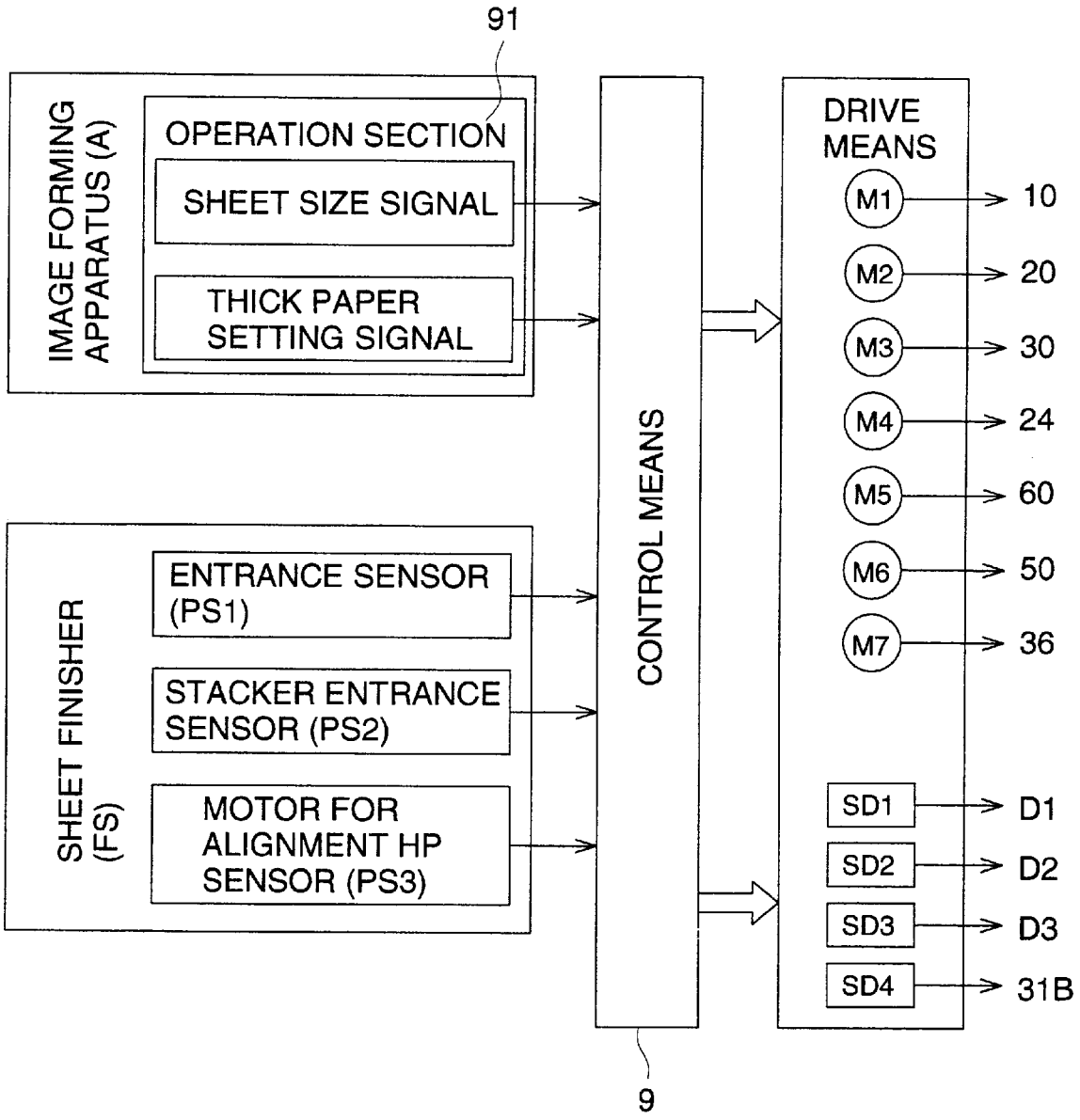
FIG. 23 is a block diagram for controlling the drive means.

FIG. 23 is a block diagram for controlling the drive means.

Before the staple-processing by the sheet finisher FS, the sheet size signal of the sheets to be subjected to image forming and the thick sheet setting signal are transmitted from the operation section 91 of the image forming apparatus mainframe A to the control means 9 of the sheet finisher FS. The sheet having an image already formed on it is brought in the sheet finisher FS, the passing of the sheet through the path a is detected by the entrance sensor PS1, the passing of the sheet through the path h is detected by the intermediate stacker entrance sensor PS2, and these detection signals are inputted in the control means 9.

The control means 9 processes the above-mentioned inputted signals, to actuate the drive means composed of a motor and a solenoid.

Figure 24:
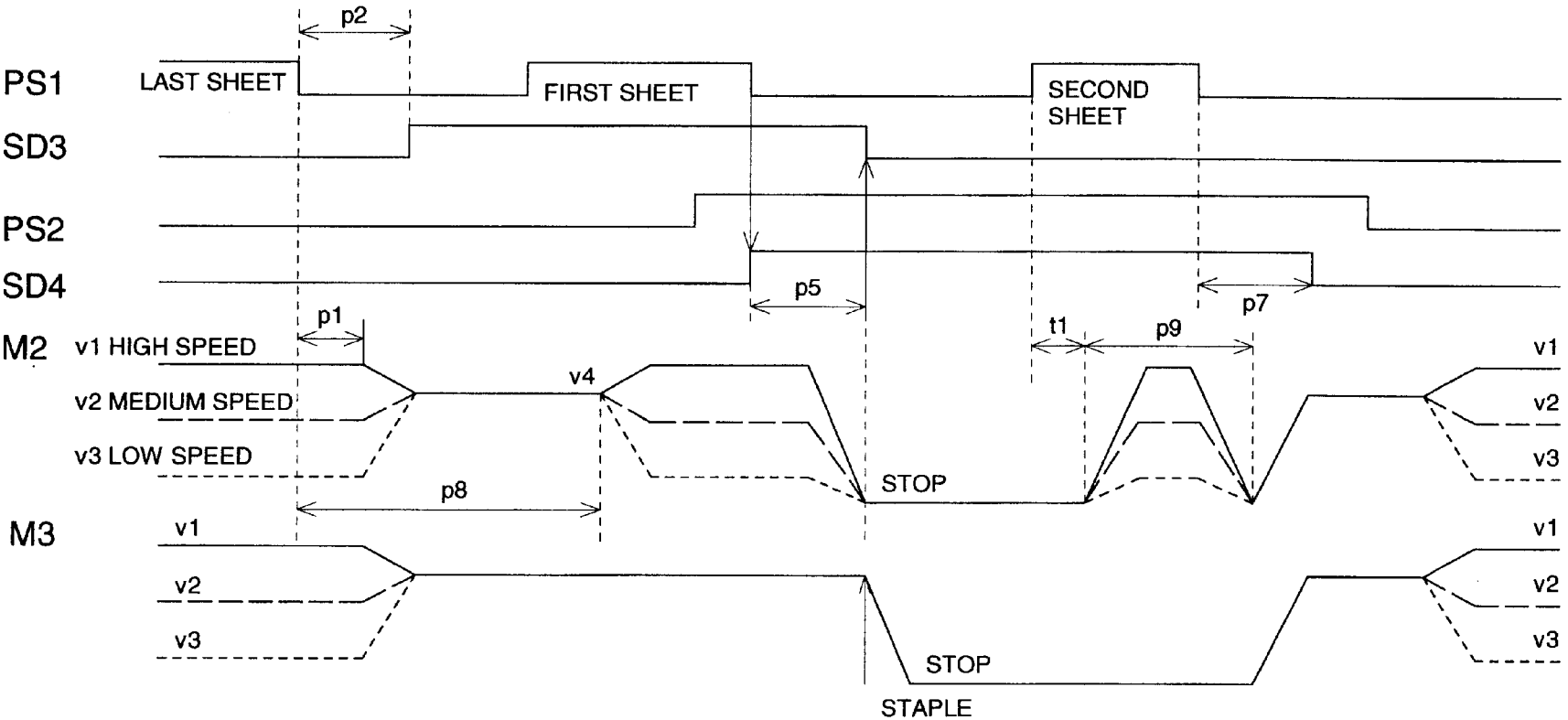
FIG. 24 is a timing chart for controlling the drive means.

FIG. 24 is a timing chart for controlling the drive means. In the following, the finish-processing procedure based on the conveyance of two overlapped small-sized sheets will be shown.

(1) In the image forming apparatus mainframe A, the sheets are conveyed at the high speed v1 in the simplex recording mode of usual sheets, at the medium speed v2 in the duplex recording mode of usual sheets, or at the low speed v3 in the recording mode of thick sheets.

(2) When p1 pulses have been counted after the passing of the trailing edge of the last sheet of the preceding bunch of sheets was detected by the entrance sensor PS1, the above-described speed v1, v2, or v3 is switched over to the predetermined constant speed v4.

(3) When p2 pulses have been counted after the passing of the trailing edge of the last sheet of the preceding bunch of sheets was detected by the entrance sensor PS1, the solenoid SD3 is actuated to open the path g1, to make it possible for the first sheet P1 for the succeeding bunch of sheets to pass through it (refer to FIG. 4).

(4) With respect to the sheet P1, which has been discharged from the image forming apparatus mainframe A, by the start of the driving by the drive motor M1, M2, and M3, when the passing of the trailing edge of the first sheet P1 for the succeeding bunch of sheets is detected by the entrance sensor PS1, the solenoid SD4 is actuated, to reduce the pressing force of the follower roller 31B through the oscillation driving member 49 and the oscillating member 46, and the sheet conveyance in the condition of two sheets being overlapped is made possible (refer to FIG. 7).

(5) When p8 pulses have been counted after the passing of the trailing edge of the last sheet of the preceding bunch of sheets was detected by the entrance sensor PS1, the predetermined constant speed v4 of the drive motors M1 and M2 is switched over to the above-described speed v1, v2, or v3.

(6) When p5 pulses have been counted after the passing of the trailing edge portion of the first sheet of the succeeding bunch of sheets was detected by the entrance sensor PS1, the solenoid SD3 is made off to intercept the path g1, while opening the path g2, to make it possible for the sheets on and after the sheet P2 to pass through it.

(7) After p5 pulses have been counted, the rotations of the drive motor M1 and the drive motor M2 are stopped successively. During this stop, the staple-processing for the preceding bunch of sheets is carried out.

(8) When the time t1 has passed according to the timer after the passing of the leading edge portion of the second sheet P2 was detected, the drive motor M2 starts driving, to rotate the conveyance rollers 31 at the set speed v1, v2, or v3 to convey the sheets P1 and P2 in the overlapped condition.

(9) At the timing when further p1 pulses have been counted after the passage of the time t1, the drive motor M1 starts driving, to carry out the conveyance of the succeeding sheets.

(10) Further, in the case of conveying thick sheets, the following procedure is added: when p7 pulses have been counted after the passing of the trailing edge portion of the second sheet P2 was detected by the entrance sensor PS1, the solenoid SD4 is made off, to strengthen the pressing force of the follower roller 31B, to make the conveyance of thick sheets possible.

In order to convey a thick sheet by the conveyance rollers 31, a large conveyance force is required, and further, in order to convey the thick sheets in the condition of two sheets being overlapped, a larger conveyance force is required.

For this reason, by such a weak conveyance force as not to produce problems such as the damage of the leading edge portion of a sheet produced when it is stopped by the conveyance rollers 32 for stopping sheets at the down stream side, poor conveyance, and the smudging of the rollers, it is not possible to convey overlapped two sheets of thick sheet.

When the thick sheet setting is made at the operation panel in the image forming apparatus mainframe, or the thick sheet is recognized by the sheet thickness detecting sensor, because the thick sheet conveyance in the image forming apparatus mainframe A is carried out at a speed slower than that for usual sheets in order to form a satisfactory image on a thick sheet, there is no need for the conveyance of the thick sheet in the condition of overlapped two sheets but enough time to convey the two sheets P1 and P2 successively while the preceding bunch of sheets is processed to be stapled. Therefore, in the case where the thick sheet signal is outputted from the image forming apparatus mainframe A, the two overlapped sheet conveyance is not carried out, and a single sheet of thick sheet is conveyed with a weak conveyance force, hence, the two overlapped sheet conveyance is carried out only in the case of usual sheets.

Further, in conventional method of conveying thick sheets, the driving of staplers is carried out at the same timer value in the same way as the usual sheet from the timing of the detection of the trailing edge of the sheet by the intermediate stacker entrance sensor PS2; however, with respect to thick sheets, of which the condition varies remarkably depending on the kinds of thick sheet, some dispersion is produced in the passage time of sheets from the intermediate stacker entrance sensor PS2 to the conveyance rollers 32 at the entrance of the intermediate stacker. Especially, in the case of sheets having a smooth surface and a high stiffness, the passage time is prolonged to a large degree, and the last sheets can not reach the stopper 35 of the stapler 50 before the practice of staple-processing, to produce some deviation in the conveying direction for the last sheet, which makes poor truing up of sheets.

The delay in the arrival time in conveying thick sheets is produced by the resistance against the passing of the sheet P in sliding contact with the curved portion formed at the lower portion of the path h between the fixed guide plate 41 and the movable guide plate 42, the slip between the conveyance rollers 32 at the downstream side and the leading edge portion of the sheet P, etc.

In order to solve the above-described problem, if the time from the intermediate stacker entrance sensor PS2 to the stapler driving is prolonged, in the case where usual sheets are conveyed, it may be possible that the sheet conveyance speed in the sheet-finisher FS can not follow the sheet conveyance speed in the image forming apparatus mainframe.

In this invention, because the interval between the sheets becomes short to make the staple-processing not practicable in time, the timing based on the timer is delayed only in the thick sheet conveyance mode in which conveyance speed is slow, to prevent the deviation in the conveyance direction at the time of staple-processing by absorbing the dispersion in the passage time of thick sheets.

An example of practice of delaying the timing according to this invention will be shown in the following.

The standby time for the aligning operation by the width aligning members 36, after the detection of the leading edge portion of the sheet P by the intermediate stacker entrance sensor PS2, is set as follows. The staple-processing is carried out after the completion of the aligning operation.

Usual alignment of large-sized usual sheets: t1 (for example,: 230 ms);

Last sheet alignment of large-sized usual sheets: t1;

Usual alignment of large-sized thick sheets: t1;

Usual alignment of small-sized usual sheets: t2 (for example, 140 ms);

Last sheet alignment of small-sized usual sheets: t2;

Usual alignment of small-sized thick sheets: t2;

Last sheet alignment of small-sized thick sheets: t3 (for example, 240 ms); and

Last sheet alignment of large-sized thick sheets: t4 (for example, 330 ms).

As described in the above, the standby time t3 for the last sheet alignment of small-sized thick sheets is made to be the sum of the standby time t2 for the usual alignment of small-sized thick sheets added by 100 ms. Further, the standby time t4 for the last sheet alignment of large-sized thick sheets is made to be the sum of the standby time t1 for the usual alignment of large-sized thick sheets added by 100 ms.

By setting the delayed timing as described in the above, it is prevented the deviation of the last sheet in the conveying direction which is generated in the case of stapling thick sheets, and the leading edge portion of the sheet can reach the stopper 35 before staple-processing.

With respect to the recognizing means for recognizing the thickness of a sheet, the thick sheet setting can be made by selecting and setting using the thick sheet setting means provided in the operation panel of the image forming apparatus mainframe A. In other way, it can be done by a recognizing means for detecting the thickness or the stiffness of a sheet.

Besides, in the embodiments of this invention, a sheet finisher connected to a copying machine has been shown; however, the invention can be applied to a sheet finisher to be used by being connected to an image forming apparatus such as a printer and a facsimile apparatus, light duty pressing machine, etc.

According to the sheet finisher of this invention, the following effects can be obtained:

(1) When a bunch of sheets are staple-processed, by gripping and conveying the initial two usual sheets in the overlapped condition, the standby time in the sheet conveyance at the time of staple-processing is shortened, while the damage of sheets is prevented, to improve the sheet conveyance performance; thus, it is accomplished to provide a compact sheet finisher capable of conveying thick sheets while securing print productivity.

(2) It is accomplished to provide a sheet finisher wherein good conveyance performance in the condition of two sheets being overlapped is compatible with thick sheet conveyance.

(3) By setting the conveyance rollers to a light conveying pressure for carrying out a good conveyance in the condition of two sheets being overlapped and changing the setting to a strong conveyance pressure for thick sheet conveyance, it is accomplished to provide a sheet finisher capable of conveying thick sheets while securing the productivity of usual sheets.

(4) It is accomplished to provide a sheet finisher capable of enlarging the range of sheets to be conveyed to a wide range from a thin sheet to a thick sheet without using such a strong spring for pressing the conveyance rollers as to give damage to sheets.

(5) It is accomplished to provide an image forming apparatus equipped with a sheet finisher capable of conveying thick sheets while securing print productivity, by selecting and controlling an optimum sheet conveying condition on the basis of it that the sheet finisher recognizes the information inputted to the image forming apparatus mainframe.

(6) The sheet finisher of this invention should not be limited to one for use with a copying machine, but can be applied to one used with any one of various kinds of sheet processing apparatus such as a printer, a facsimile apparatus, and a light duty printing machine, to accomplish a stable sheet conveyance.

(7) In the case where small-sized sheets are conveyed in the condition of two sheets being overlapped at the entrance of the intermediate stacker and stacked on the intermediate stacker to be trued up by the width aligning members, it is accomplished a good truing up of sheets by it that, when the sheets which have been conveyed in the state of two sheets being overlapped are subjected to the width alignment, the problem of poor truing up of sheets owing to the mutual attraction of the two sheets induced by static electricity etc. is solved by increasing the number of alignments, or strengthening the pressing force by shortening the compression width for alignment, and after that, usual aligning operation is carried out.

(8) Because the aligning operation is not made varied but is kept in the initial condition if the thick sheet mode is set, when the side edges of the thick sheets in the width direction are aligned by the aligning plates of the aligning means, the width aligning plates do not strongly press the side edges of the thick sheets in the width direction, which makes it never occur that the stepping motor for driving the aligning plates goes out of tuning owing to the resisting force, and it also does not occur that the sheet truing-up performance after that is lowered.

(9) When thick sheets are conveyed, some dispersion is produced in the passage time of sheets from the sheet passage detecting sensor to the conveyance rollers at the entrance of the intermediate stacker. Especially, in the case of sheets having a smooth surface and a high stiffness, the above-described passage time of sheets is prolonged to a large degree, and the trailing edge portion of the last sheets can not reach the stopper in the vicinity of the stapler before the start of staple-processing, to produce some deviation of the leading edge portion of the last sheet, which makes poor truing up of sheets after being staple-processed. According to this invention, when thick sheets are conveyed, because the timer value for the staple-processing after the passage of the sheet through the detecting means which makes the trigger for the staple-processing is prolonged only for the thick sheet conveyance, it becomes possible to prevent the stapling deviation of thick sheets, while securing the print productivity.

(10) By selecting and controlling an optimum sheet conveyance condition on the basis of it that the sheet finisher recognizes the information inputted to the image forming apparatus, it is accomplished to provide an image forming apparatus equipped with a sheet finisher capable of conveying thick sheets while securing the print productivity.

What is claimed is:

1. A sheet conveyance apparatus, comprising:

a sheet conveyance path along which a sheet is conveyed;

a first conveyance means for gripping and conveying said sheet along said sheet conveyance path;

a gripping pressure change means for changing a gripping pressure of said first conveyance means; and a controller to control said gripping pressure change means in response to a thickness of said sheet gripped and conveyed by said first conveyance means.

2. The sheet conveyance apparatus of claim 1, wherein said controller controls said gripping pressure change means so as to reduce said gripping pressure applied by said first conveyance means, when said controller receives a signal of thick sheet setting mode from an external device.

3. The sheet conveyance apparatus of claim 1, wherein said gripping pressure change means comprises a leaf spring, an oscillating member, an oscillation driving means, an oscillation receiving member and a solenoid.

4. The sheet conveyance apparatus of claim 1, wherein said first conveyance means comprises a first driving roller and a first follower roller which are movable relative to each other between a touched state and an open state under a driving action of said gripping pressure change means, and said sheet conveyance path comprises a protrusion to force said sheet toward said first driving roller so as to enable a conveying action of said sheet when said first driving roller and said first follower roller are in said open state.

5. The sheet conveyance apparatus of claim 1, further comprising:

an intermediate stacker, disposed downstream of said first conveyance means in terms of a sheet conveying direction, to stack and store said sheet conveyed along said sheet conveyance path by said first conveyance means; and a binder to bind a bunch of sheets stacked and stored on said intermediate stacker.

6. The sheet conveyance apparatus of claim 5, further comprising:

a second conveyance means comprised of a second driving roller and a second follower roller, and disposed at a position located between said first conveyance means and said intermediate stacker in said sheet conveyance path, wherein said second driving roller comprises a rotational axis, a roller member, a first flange mounted on said rotational axis in the vicinity of one end of said roller member and a second flange mounted on said rotational axis in the vicinity of another end of said roller member, and an elastic force of said first flange is different from that of said second flange.

7. The sheet conveyance apparatus of claim 6, wherein said elastic force of said second flange is larger than that of said first flange, and first outer-diameter d1 of said first flange, second outer-diameter d2 of said second flange and third outer-diameter d3 of said roller member fulfill a following relationship:

$$d1>d2>d3.$$

8. The sheet conveyance apparatus of claim 5, further comprising:

a second conveyance means, disposed at a position located between said first conveyance means and said intermediate stacker in said sheet conveyance path, to grip and convey said sheet, wherein said controller controls actions of said second conveyance means, in such a manner that a plurality of sheets are conveyed in a stacked state by starting a gripping action and conveying action of said second conveyance means, after leading edges of said sheets are butted against said second conveyance means stopped by said controller.

9. The sheet conveyance apparatus of claim 8, wherein controlling actions for gripping and conveying said plurality of sheets in a stacked state is disabled when a first bunch of said sheets is formed, but is enabled when a second or later bunch of said sheets is formed.

10. The sheet conveyance apparatus of claim 8, wherein said controller controls said gripping pressure change means so that said first conveyance means grips said sheet with a first gripping pressure when conveying one sheet, while said first conveyance means grips said sheet with a second gripping pressure when conveying said plurality of sheets in a stacked state.

11. The sheet conveyance apparatus of claim 10, wherein said second gripping pressure is less than said first gripping pressure.

12. The sheet conveyance apparatus of claim 8, wherein said controller disables actions for gripping and conveying said plurality of sheets in a stacked state when conveying a thick sheet.

13. The sheet conveyance apparatus of claim 12, wherein said controller disables actions for gripping and conveying said plurality of sheets in a stacked state, when said controller receives a signal of thick sheet setting mode from an external device.

14. An image forming apparatus, comprising:

the sheet conveyance apparatus recited in claim 1.

* * * * *